US009364131B2

(12) United States Patent
Fountain et al.

(10) Patent No.: US 9,364,131 B2
(45) **Date of Patent: *Jun. 14, 2016**

(54) ROTATING FILTER FOR A DISHWASHING MACHINE

(71) Applicant: Whirlpool Corporation, Benton Harbor, MI (US)

(72) Inventors: Jordan R. Fountain, San Francisco, CA (US); Todd M. Jozwiak, Benton Harbor, MI (US); Antony M. Rappette, Benton Harbor, MI (US); Rodney M. Welch, Eau Claire, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 460 days.

This patent is subject to a terminal disclaimer.

(21) Appl. No.: 13/855,770

(22) Filed: Apr. 3, 2013

(65) Prior Publication Data

US 2013/0186438 A1 Jul. 25, 2013

Related U.S. Application Data

(63) Continuation of application No. 13/163,945, filed on Jun. 20, 2011, now Pat. No. 8,627,832, which is a continuation-in-part of application No. 12/966,420, filed on Dec. 13, 2010, now Pat. No. 8,667,974.

(51) Int. Cl.
*A47L 15/02* (2006.01)
*A47L 15/42* (2006.01)

(52) U.S. Cl.
CPC ..... *A47L 15/4206* (2013.01); *A47L 15/4208* (2013.01); *A47L 15/4219* (2013.01)

(58) Field of Classification Search
CPC . A47L 15/42; A47L 15/4202; A47L 15/4206; A47L 15/4208; A47L 15/4214; A47L 15/4219; B08B 3/00; B08B 3/04
USPC ..... 134/104.4, 104.1, 11, 110, 201
See application file for complete search history.

(56) References Cited

U.S. PATENT DOCUMENTS

| | | | |
|---|---|---|---|
| 1,617,021 | A | 2/1927 | Mitchell |
| 2,154,559 | A | 4/1939 | Bilde |
| 2,422,022 | A | 6/1947 | Koertge |
| 2,734,122 | A | 2/1956 | Flannery |
| 3,016,147 | A | 1/1962 | Cobb et al. |

(Continued)

FOREIGN PATENT DOCUMENTS

| | | |
|---|---|---|
| CH | 169630 | 6/1934 |
| CN | 2571812 | 9/2003 |

(Continued)

OTHER PUBLICATIONS

German Search Report for Counterpart DE102013109125, Dec. 9, 2013.

(Continued)

*Primary Examiner* — Saeed T Chaudhry

(57) ABSTRACT

A dishwasher with a tub at least partially defining a washing chamber, a liquid spraying system for spraying liquid into the washing chamber, a liquid recirculation system defining a recirculation flow path from the washing chamber to the spraying system, and a liquid filtering system. The liquid filtering system includes a rotating filter disposed in the recirculation flow path to filter the liquid.

8 Claims, 13 Drawing Sheets

(56) References Cited

U.S. PATENT DOCUMENTS

| | | | | |
|---|---|---|---|---|
| 3,026,628 | A | 3/1962 | Berger, Sr. et al. | |
| 3,068,877 | A | 12/1962 | Jacobs | |
| 3,103,227 | A | 9/1963 | Long | |
| 3,122,148 | A | 2/1964 | Alabaster | |
| 3,186,417 | A | 6/1965 | Fay | |
| 3,288,154 | A | 11/1966 | Jacobs | |
| 3,542,594 | A | 11/1970 | Smith et al. | |
| 3,575,185 | A | 4/1971 | Barbulesco | |
| 3,586,011 | A | 6/1971 | Mazza | |
| 3,739,145 | A | 6/1973 | Woehler | |
| 3,801,280 | A | 4/1974 | Shah et al. | |
| 3,846,321 | A | 11/1974 | Strange | |
| 3,906,967 | A | 9/1975 | Bergeson | |
| 3,989,054 | A | 11/1976 | Mercer | |
| 4,179,307 | A | 12/1979 | Cau et al. | |
| 4,180,095 | A | 12/1979 | Woolley et al. | |
| 4,228,962 | A | 10/1980 | Dingler et al. | |
| 4,326,552 | A | 4/1982 | Bleckmann | |
| 4,754,770 | A | 7/1988 | Fornasari | |
| 5,002,890 | A | 3/1991 | Morrison | |
| 5,030,357 | A | 7/1991 | Lowe | |
| 5,133,863 | A | 7/1992 | Zander | |
| 5,331,986 | A | 7/1994 | Lim et al. | |
| 5,454,298 | A | 10/1995 | Lu | |
| 5,470,142 | A | 11/1995 | Sargeant et al. | |
| 5,470,472 | A | 11/1995 | Baird et al. | |
| 5,557,704 | A | 9/1996 | Dennis et al. | |
| 5,569,383 | A | 10/1996 | Vander Ark, Jr. et al. | |
| 5,618,424 | A | 4/1997 | Nagaoka | |
| 5,630,437 | A | 5/1997 | Dries et al. | |
| 5,711,325 | A | 1/1998 | Kloss et al. | |
| 5,755,244 | A | 5/1998 | Sargeant et al. | |
| 5,782,112 | A | 7/1998 | White et al. | |
| 5,803,100 | A | 9/1998 | Thies | |
| 5,865,997 | A | 2/1999 | Isaacs | |
| 5,868,937 | A | 2/1999 | Back et al. | |
| 5,904,163 | A | 5/1999 | Inoue et al. | |
| 5,924,432 | A | 7/1999 | Thies et al. | |
| 6,289,908 | B1 | 9/2001 | Kelsey | |
| 6,389,908 | B1 | 5/2002 | Chevalier et al. | |
| 6,460,555 | B1 | 10/2002 | Tuller et al. | |
| 6,491,049 | B1 | 12/2002 | Tuller et al. | |
| 6,601,593 | B2 | 8/2003 | Deiss et al. | |
| 6,666,976 | B2 | 12/2003 | Benenson, Jr. et al. | |
| 6,800,197 | B1 | 10/2004 | Kosola et al. | |
| 6,997,195 | B2 | 2/2006 | Durazzani et al. | |
| 7,047,986 | B2 | 5/2006 | Ertle et al. | |
| 7,069,181 | B2 | 6/2006 | Jerg et al. | |
| 7,093,604 | B2 | 8/2006 | Jung et al. | |
| 7,153,817 | B2 | 12/2006 | Binder | |
| 7,198,054 | B2 | 4/2007 | Welch | |
| 7,208,080 | B2 | 4/2007 | Batten et al. | |
| 7,232,494 | B2 | 6/2007 | Rappette | |
| 7,250,174 | B2 | 7/2007 | Lee et al. | |
| 7,270,132 | B2 | 9/2007 | Inui et al. | |
| 7,319,841 | B2 | 1/2008 | Bateman, III et al. | |
| 7,326,338 | B2 | 2/2008 | Batten et al. | |
| 7,347,212 | B2 | 3/2008 | Rosenbauer | |
| 7,350,527 | B2 | 4/2008 | Gurubatham et al. | |
| 7,363,093 | B2 | 4/2008 | King et al. | |
| 7,406,843 | B2 | 8/2008 | Thies et al. | |
| 7,445,013 | B2 | 11/2008 | VanderRoest et al. | |
| 7,497,222 | B2 | 3/2009 | Edwards et al. | |
| 7,523,758 | B2 | 4/2009 | VanderRoest et al. | |
| 7,594,513 | B2 | 9/2009 | Vanderroest et al. | |
| 7,819,983 | B2 | 10/2010 | Kim et al. | |
| 7,896,977 | B2 | 3/2011 | Gillum et al. | |
| 8,043,437 | B1 | 10/2011 | Delgado et al. | |
| 8,161,986 | B2 | 4/2012 | Alessandrelli | |
| 8,215,322 | B2 | 7/2012 | Fountain et al. | |
| 8,627,832 | B2 * | 1/2014 | Fountain et al. | 134/104.4 |
| 8,667,974 | B2 * | 3/2014 | Fountain et al. | 134/104.4 |
| 8,746,261 | B2 | 6/2014 | Welch | |
| 9,005,369 | B2 | 4/2015 | Delgado et al. | |
| 2002/0017483 | A1 | 2/2002 | Chesner et al. | |
| 2003/0037809 | A1 | 2/2003 | Favaro | |
| 2003/0205248 | A1 | 11/2003 | Christman et al. | |
| 2004/0007253 | A1 | 1/2004 | Jung et al. | |
| 2004/0103926 | A1 | 6/2004 | Ha | |
| 2005/0022849 | A1 | 2/2005 | Park et al. | |
| 2005/0133070 | A1 | 6/2005 | Vanderroest et al. | |
| 2006/0005863 | A1 | 1/2006 | Gurubatham et al. | |
| 2006/0054549 | A1 | 3/2006 | Schoendorfer | |
| 2006/0123563 | A1 | 6/2006 | Raney et al. | |
| 2006/0162744 | A1 | 7/2006 | Walkden | |
| 2006/0174915 | A1 | 8/2006 | Hedstrom et al. | |
| 2006/0236556 | A1 | 10/2006 | Ferguson et al. | |
| 2006/0237049 | A1 | 10/2006 | Weaver et al. | |
| 2007/0006898 | A1 | 1/2007 | Lee | |
| 2007/0107753 | A1 | 5/2007 | Jerg | |
| 2007/0163626 | A1 | 7/2007 | Klein | |
| 2007/0186964 | A1 | 8/2007 | Mason et al. | |
| 2007/0246078 | A1 | 10/2007 | Purtilo et al. | |
| 2007/0266587 | A1 | 11/2007 | Bringewatt et al. | |
| 2008/0116135 | A1 * | 5/2008 | Rieger et al. | 210/650 |
| 2008/0289654 | A1 | 11/2008 | Kim et al. | |
| 2008/0289664 | A1 | 11/2008 | Rockwell et al. | |
| 2009/0095330 | A1 | 4/2009 | Iwanaga et al. | |
| 2009/0283111 | A1 | 11/2009 | Classen et al. | |
| 2010/0012159 | A1 | 1/2010 | Verma et al. | |
| 2010/0043826 | A1 | 2/2010 | Bertsch et al. | |
| 2010/0043828 | A1 | 2/2010 | Choi et al. | |
| 2010/0043847 | A1 | 2/2010 | Yoon et al. | |
| 2010/0121497 | A1 | 5/2010 | Heisele et al. | |
| 2010/0154830 | A1 | 6/2010 | Lau et al. | |
| 2010/0154841 | A1 | 6/2010 | Fountain et al. | |
| 2010/0224223 | A1 | 9/2010 | Kehl et al. | |
| 2010/0252081 | A1 | 10/2010 | Classen et al. | |
| 2010/0300499 | A1 | 12/2010 | Han et al. | |
| 2011/0061682 | A1 | 3/2011 | Fountain et al. | |
| 2011/0120508 | A1 | 5/2011 | Yoon et al. | |
| 2011/0126865 | A1 * | 6/2011 | Yoon et al. | 134/104.1 |
| 2011/0146714 | A1 | 6/2011 | Fountain et al. | |
| 2011/0146730 | A1 | 6/2011 | Welch | |
| 2011/0146731 | A1 | 6/2011 | Fountain et al. | |
| 2012/0097200 | A1 | 4/2012 | Fountain | |
| 2012/0118330 | A1 | 5/2012 | Tuller et al. | |
| 2012/0118336 | A1 | 5/2012 | Welch | |
| 2012/0138096 | A1 | 6/2012 | Tuller et al. | |
| 2012/0138106 | A1 | 6/2012 | Fountain et al. | |
| 2012/0138107 | A1 | 6/2012 | Fountain et al. | |
| 2012/0291805 | A1 | 11/2012 | Tuller et al. | |
| 2012/0291822 | A1 | 11/2012 | Tuller et al. | |
| 2012/0318295 | A1 | 12/2012 | Delgado et al. | |
| 2012/0318296 | A1 | 12/2012 | Fountain et al. | |
| 2012/0318308 | A1 | 12/2012 | Fountain et al. | |
| 2012/0318309 | A1 | 12/2012 | Tuller et al. | |

FOREIGN PATENT DOCUMENTS

| | | | |
|---|---|---|---|
| CN | 2761660 | | 3/2006 |
| CN | 1966129 | | 5/2007 |
| CN | 2907830 | | 6/2007 |
| CN | 101406379 | | 4/2009 |
| CN | 201276653 | | 7/2009 |
| CN | 201361486 | | 12/2009 |
| CN | 101654855 | | 2/2010 |
| CN | 201410325 | | 2/2010 |
| CN | 201473770 | | 5/2010 |
| DE | 1134489 | | 8/1961 |
| DE | 1428358 | A1 | 11/1968 |
| DE | 1453070 | | 3/1969 |
| DE | 7105474 | | 8/1971 |
| DE | 7237309 | U | 9/1973 |
| DE | 2825242 | A1 | 1/1979 |
| DE | 3337369 | A1 | 4/1985 |
| DE | 3723721 | A1 | 5/1988 |
| DE | 3842997 | A1 | 7/1990 |
| DE | 4011834 | A1 | 10/1991 |
| DE | 4016915 | A1 | 11/1991 |
| DE | 4131914 | A1 | 4/1993 |
| DE | 9415486 | U1 | 11/1994 |
| DE | 9416710 | U1 | 1/1995 |
| DE | 4413432 | C1 | 8/1995 |

(56) References Cited

FOREIGN PATENT DOCUMENTS

| | | | |
|---|---|---|---|
| DE | 4418523 | A1 | 11/1995 |
| DE | 4433842 | | 3/1996 |
| DE | 69111365 | T2 | 3/1996 |
| DE | 19546965 | A1 | 6/1997 |
| DE | 69403957 | T2 | 1/1998 |
| DE | 19652235 | | 6/1998 |
| DE | 10000772 | A1 | 7/2000 |
| DE | 69605965 | T2 | 8/2000 |
| DE | 19951838 | A1 | 5/2001 |
| DE | 10065571 | A1 | 7/2002 |
| DE | 10106514 | A1 | 8/2002 |
| DE | 60206490 | T2 | 5/2006 |
| DE | 60302143 | | 8/2006 |
| DE | 102005023428 | A1 | 11/2006 |
| DE | 102005038433 | A1 | 2/2007 |
| DE | 102007007133 | A1 | 8/2008 |
| DE | 102007060195 | A1 | 6/2009 |
| DE | 202010006739 | U1 | 8/2010 |
| DE | 102009027910 | A1 | 1/2011 |
| DE | 102009028278 | A1 | 2/2011 |
| DE | 102010061215 | A1 | 6/2011 |
| DE | 102011052846 | A1 | 5/2012 |
| DE | 102012103435 | A1 | 12/2012 |
| EP | 0068974 | A1 | 1/1983 |
| EP | 0178202 | A1 | 4/1986 |
| EP | 0198496 | A1 | 10/1986 |
| EP | 0208900 | A2 | 1/1987 |
| EP | 0370552 | A1 | 5/1990 |
| EP | 0374616 | A1 | 6/1990 |
| EP | 0383028 | A2 | 8/1990 |
| EP | 0405627 | A1 | 1/1991 |
| EP | 437189 | A1 | 7/1991 |
| EP | 0454640 | A1 | 10/1991 |
| EP | 0521815 | A1 | 1/1993 |
| EP | 0585905 | A2 | 9/1993 |
| EP | 0702928 | A1 | 8/1995 |
| EP | 0597907 | B1 | 12/1995 |
| EP | 0725182 | A1 | 8/1996 |
| EP | 0748607 | A2 | 12/1996 |
| EP | 0752231 | A1 | 1/1997 |
| EP | 752231 | A1 | 1/1997 |
| EP | 0854311 | A2 | 7/1998 |
| EP | 0855165 | A2 | 7/1998 |
| EP | 0898928 | A1 | 3/1999 |
| EP | 1029965 | A1 | 8/2000 |
| EP | 1224902 | A2 | 7/2002 |
| EP | 1256308 | A2 | 11/2002 |
| EP | 1264570 | | 12/2002 |
| EP | 1319360 | A1 | 6/2003 |
| EP | 1342827 | | 9/2003 |
| EP | 1346680 | A2 | 9/2003 |
| EP | 1386575 | A1 | 2/2004 |
| EP | 1415587 | | 5/2004 |
| EP | 1498065 | A1 | 1/2005 |
| EP | 1583455 | A1 | 10/2005 |
| EP | 1703834 | A1 | 9/2006 |
| EP | 1743871 | A1 | 1/2007 |
| EP | 1862104 | A1 | 12/2007 |
| EP | 1882436 | A1 | 1/2008 |
| EP | 1980193 | A1 | 10/2008 |
| EP | 2127587 | A1 | 2/2009 |
| EP | 2075366 | A1 | 7/2009 |
| EP | 2138087 | A1 | 12/2009 |
| EP | 2332457 | A1 | 6/2011 |
| EP | 2335547 | A1 | 6/2011 |
| EP | 2338400 | A1 | 6/2011 |
| EP | 2351507 | A1 | 8/2011 |
| FR | 1370521 | A | 8/1964 |
| FR | 2372363 | A1 | 6/1978 |
| FR | 2491320 | A1 | 4/1982 |
| FR | 2491321 | A1 | 4/1982 |
| FR | 2790013 | A1 | 8/2000 |
| GB | 973859 | A | 10/1964 |
| GB | 1047948 | | 11/1966 |
| GB | 1123789 | A | 8/1968 |
| GB | 1515095 | | 6/1978 |
| GB | 2274772 | A | 8/1994 |
| JP | 55039215 | A | 3/1980 |
| JP | 60069375 | A | 4/1985 |
| JP | 61085991 | A | 5/1986 |
| JP | 61200824 | A | 9/1986 |
| JP | 1005521 | A | 1/1989 |
| JP | 1080331 | A | 3/1989 |
| JP | 5245094 | A | 9/1993 |
| JP | 07178030 | | 7/1995 |
| JP | 10109007 | A | 4/1998 |
| JP | 2000107114 | A | 4/2000 |
| JP | 2001190479 | A | 7/2001 |
| JP | 2001190480 | A | 7/2001 |
| JP | 2003336909 | A | 12/2003 |
| JP | 2003339607 | A | 12/2003 |
| JP | 2004267507 | A | 9/2004 |
| JP | 2005124979 | A | 5/2005 |
| JP | 2006075635 | A | 3/2006 |
| JP | 2007068601 | A | 3/2007 |
| JP | 2008093196 | A | 4/2008 |
| JP | 2008253543 | A | 10/2008 |
| JP | 2008264018 | A | 11/2008 |
| JP | 2008264724 | A | 11/2008 |
| JP | 2010035745 | A | 2/2010 |
| JP | 2010187796 | A | 9/2010 |
| KR | 20010077128 | | 8/2001 |
| KR | 20090006659 | | 1/2009 |
| WO | 2005058124 | A1 | 6/2005 |
| WO | 2005115216 | A1 | 12/2005 |
| WO | 2007024491 | A2 | 3/2007 |
| WO | 2007074024 | A1 | 7/2007 |
| WO | 2008067898 | A1 | 6/2008 |
| WO | 2008125482 | | 10/2008 |
| WO | 2009018903 | A1 | 2/2009 |
| WO | 2009065696 | A1 | 5/2009 |
| WO | 2009077266 | A1 | 6/2009 |
| WO | 2009077279 | A2 | 6/2009 |
| WO | 2009077280 | A1 | 6/2009 |
| WO | 2009077283 | A1 | 6/2009 |
| WO | 2009077286 | A1 | 6/2009 |
| WO | 2009077290 | A1 | 6/2009 |
| WO | 2009118308 | A1 | 10/2009 |

OTHER PUBLICATIONS

European Search Report for EP11188106, Mar. 29, 2012.
German Search Report for DE102010061347, Jan. 23, 2013.
German Search Report for DE102010061215, Feb. 7, 2013.
German Search Report for DE102010061346, Sep. 30, 2011.
German Search Report for DE102010061343, Jul. 7, 2011.
German Search Report for DE102011053666, Oct. 21, 2011.
German Search Report for DE102010061342, Aug. 19, 2011.
European Search Report for EP101952380, May 19, 2011.
European Search Report for EP12188007, Aug. 6, 2013.
German Search Report for DE102013103264, Jul. 12, 2013.
German Search Report for DE102013103625, Jul. 19, 2013.
Ishihara et al., JP 11155792 A, English Machine Translation, 1999, pp. 1-14.
German Search Report for Counterpart DE102014101260.7, Sep. 18, 2014.

* cited by examiner

ROTATING FILTER FOR A DISHWASHING MACHINE

CROSS-REFERENCE TO RELATED APPLICATIONS

The present application is a continuation of U.S. application Ser. No. 13/163,945, filed Jun. 20, 2011, which is a continuation-in-part of U.S. application Ser. No. 12/966,420, filed Dec. 13, 2010, both of which are incorporated by reference herein in their entirety.

BACKGROUND OF THE INVENTION

A dishwashing machine is a domestic appliance into which dishes and other cooking and eating wares (e.g., plates, bowls, glasses, flatware, pots, pans, bowls, etc.) are placed to be washed. A dishwashing machine includes various filters to separate soil particles from wash fluid.

SUMMARY OF THE INVENTION

In one embodiment, the invention relates to a dishwasher with a liquid spraying system, a liquid recirculation system, and a rotating filter having a first filter element forming an upstream surface and a second filter element forming a downstream surface and located in the recirculation flow path such that the recirculation flow path passes through the filter from the upstream surface to the downstream surface to effect a filtering of the sprayed liquid and wherein the rotating filter is operably coupled to the impeller of the pump to effect rotation of the rotating filter wherein the first filter element is more resistant to foreign object damage than the second filter element.

DESCRIPTION OF EMBODIMENTS OF THE INVENTION

Figure 1:
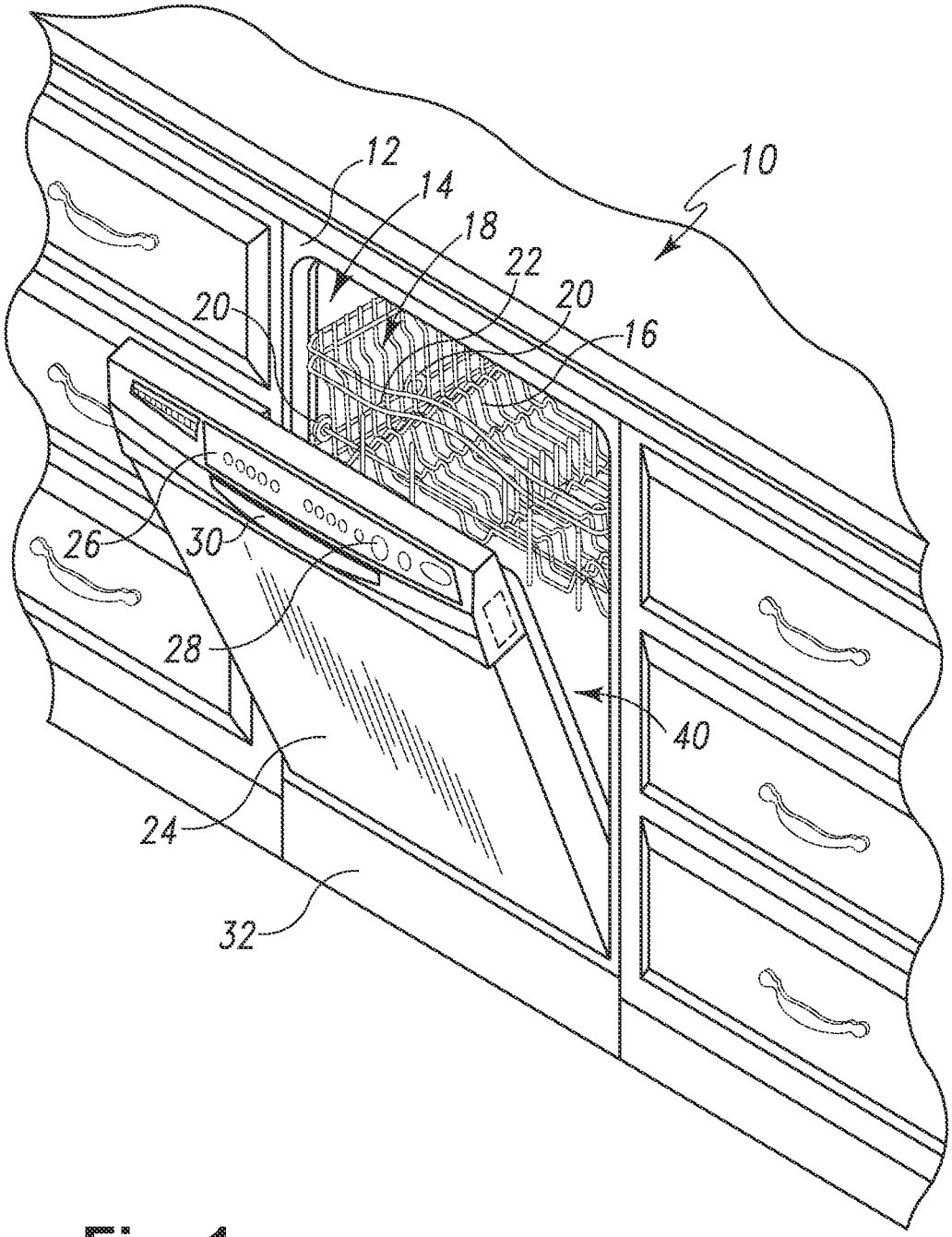
FIG. 1 is a perspective view of a dishwashing machine.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring to FIG. 1, a dishwashing machine 10 (hereinafter dishwasher 10) is shown. The dishwasher 10 has a tub 12 that at least partially defines a washing chamber 14 into which a user may place dishes and other cooking and eating wares (e.g., plates, bowls, glasses, flatware, pots, pans, bowls, etc.) to be washed. The dishwasher 10 includes a number of racks 16 located in the tub 12. An upper dish rack 16 is shown in FIG. 1, although a lower dish rack is also included in the dishwasher 10. A number of roller assemblies 18 are positioned between the dish racks 16 and the tub 12. The roller assemblies 18 allow the dish racks 16 to extend from and retract into the tub 12, which facilitates the loading and unloading of the dish racks 16. The roller assemblies 18 include a number of rollers 20 that move along a corresponding support rail 22.

A door 24 is hinged to the lower front edge of the tub 12. The door 24 permits user access to the tub 12 to load and unload the dishwasher 10. The door 24 also seals the front of the dishwasher 10 during a wash cycle. A control panel 26 is located at the top of the door 24. The control panel 26 includes a number of controls 28, such as buttons and knobs, which are used by a controller (not shown) to control the operation of the dishwasher 10. A handle 30 is also included in the control panel 26. The user may use the handle 30 to unlatch and open the door 24 to access the tub 12.

Figure 2:
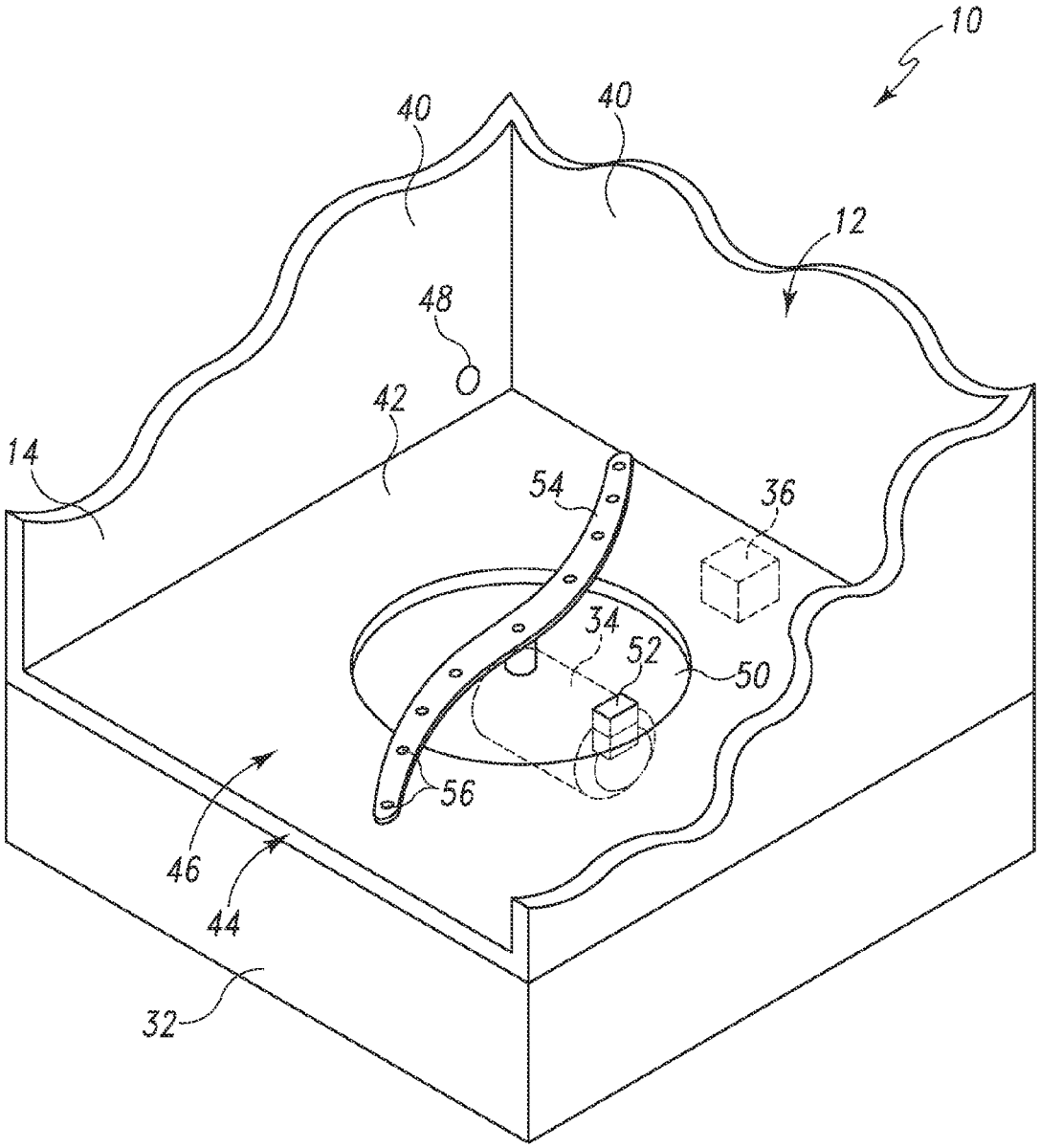
FIG. 2 is a fragmentary perspective view of the tub of the dishwashing machine of FIG. 1.

A machine compartment 32 is located below the tub 12. The machine compartment 32 is sealed from the tub 12. In other words, unlike the tub 12, which is filled with fluid and exposed to spray during the wash cycle, the machine compartment 32 does not fill with fluid and is not exposed to spray during the operation of the dishwasher 10. Referring now to FIG. 2, the machine compartment 32 houses a recirculation pump assembly 34 and the drain pump 36, as well as the dishwasher's other motor(s) and valve(s), along with the associated wiring and plumbing. The recirculation pump 36 and associated wiring and plumbing form a liquid recirculation system.

Referring now to FIG. 2, the tub 12 of the dishwasher 10 is shown in greater detail. The tub 12 includes a number of side walls 40 extending upwardly from a bottom wall 42 to define the washing chamber 14. The open front side 44 of the tub 12 defines an access opening 46 of the dishwasher 10. The access opening 46 provides the user with access to the dish racks 16 positioned in the washing chamber 14 when the door 24 is open. When closed, the door 24 seals the access opening 46, which prevents the user from accessing the dish racks 16. The door 24 also prevents fluid from escaping through the access opening 46 of the dishwasher 10 during a wash cycle.

The bottom wall 42 of the tub 12 has a sump 50 positioned therein. At the start of a wash cycle, fluid enters the tub 12 through a hole 48 defined in the side wall 40. The sloped configuration of the bottom wall 42 directs fluid into the sump 50. The recirculation pump assembly 34 removes such water and/or wash chemistry from the sump 50 through a hole 52 defined the bottom of the sump 50 after the sump 50 is partially filled with fluid.

The liquid recirculation system supplies liquid to a liquid spraying system, which includes a spray arm 54, to recirculate the sprayed liquid in the tub 12. The recirculation pump assembly 34 is fluidly coupled to a rotating spray arm 54 that sprays water and/or wash chemistry onto the dish racks 16 (and hence any wares positioned thereon) to effect a recirculation of the liquid from the washing chamber 14 to the liquid spraying system to define a recirculation flow path. Additional rotating spray arms (not shown) are positioned above the spray arm 54. It should also be appreciated that the dishwashing machine 10 may include other spray arms positioned at various locations in the tub 12. As shown in FIG. 2, the spray arm 54 has a number of nozzles 56. Fluid passes from the recirculation pump assembly 34 into the spray arm 54 and then exits the spray arm 54 through the nozzles 56. In the illustrative embodiment described herein, the nozzles 56 are embodied simply as holes formed in the spray arm 54. However, it is within the scope of the disclosure for the nozzles 56 to include inserts such as tips or other similar structures that are placed into the holes formed in the spray arm 54. Such inserts may be useful in configuring the spray direction or spray pattern of the fluid expelled from the spray arm 54.

After wash fluid contacts the dish racks 16, and any wares positioned in the washing chamber 14, a mixture of fluid and soil falls onto the bottom wall 42 and collects in the sump 50. The recirculation pump assembly 34 draws the mixture out of the sump 50 through the hole 52. As will be discussed in detail below, fluid is filtered in the recirculation pump assembly 34 and re-circulated onto the dish racks 16. At the conclusion of the wash cycle, the drain pump 36 removes both wash fluid and soil particles from the sump 50 and the tub 12.

Figure 3:
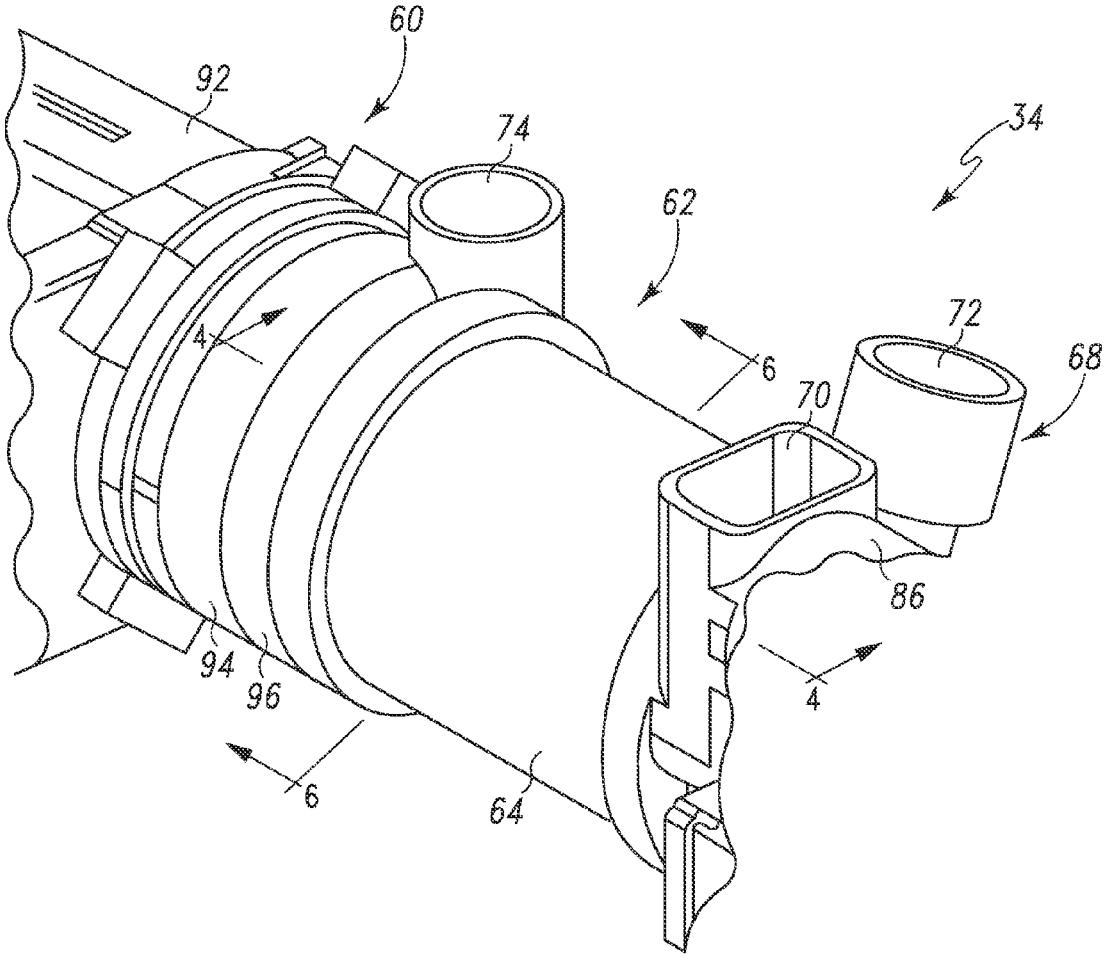
FIG. 3 is a perspective view of an embodiment of a pump and filter assembly for the dishwashing machine of FIG. 1.

Referring now to FIG. 3, the recirculation pump assembly 34 is shown removed from the dishwasher 10. The recirculation pump assembly 34 includes a wash pump 60 that is secured to a housing 62. The housing 62 includes cylindrical filter casing 64 positioned between a manifold 68 and the wash pump 60. The cylindrical filter casing 64 provides a liquid filtering system. The manifold 68 has an inlet port 70, which is fluidly coupled to the hole 52 defined in the sump 50, and an outlet port 72, which is fluidly coupled to the drain pump 36. Another outlet port 74 extends upwardly from the wash pump 60 and is fluidly coupled to the rotating spray arm 54. While recirculation pump assembly 34 is included in the dishwasher 10, it will be appreciated that in other embodiments, the recirculation pump assembly 34 may be a device separate from the dishwasher 10. For example, the recirculation pump assembly 34 might be positioned in a cabinet adjacent to the dishwasher 10. In such embodiments, a number of fluid hoses may be used to connect the recirculation pump assembly 34 to the dishwasher 10.

Figure 4:
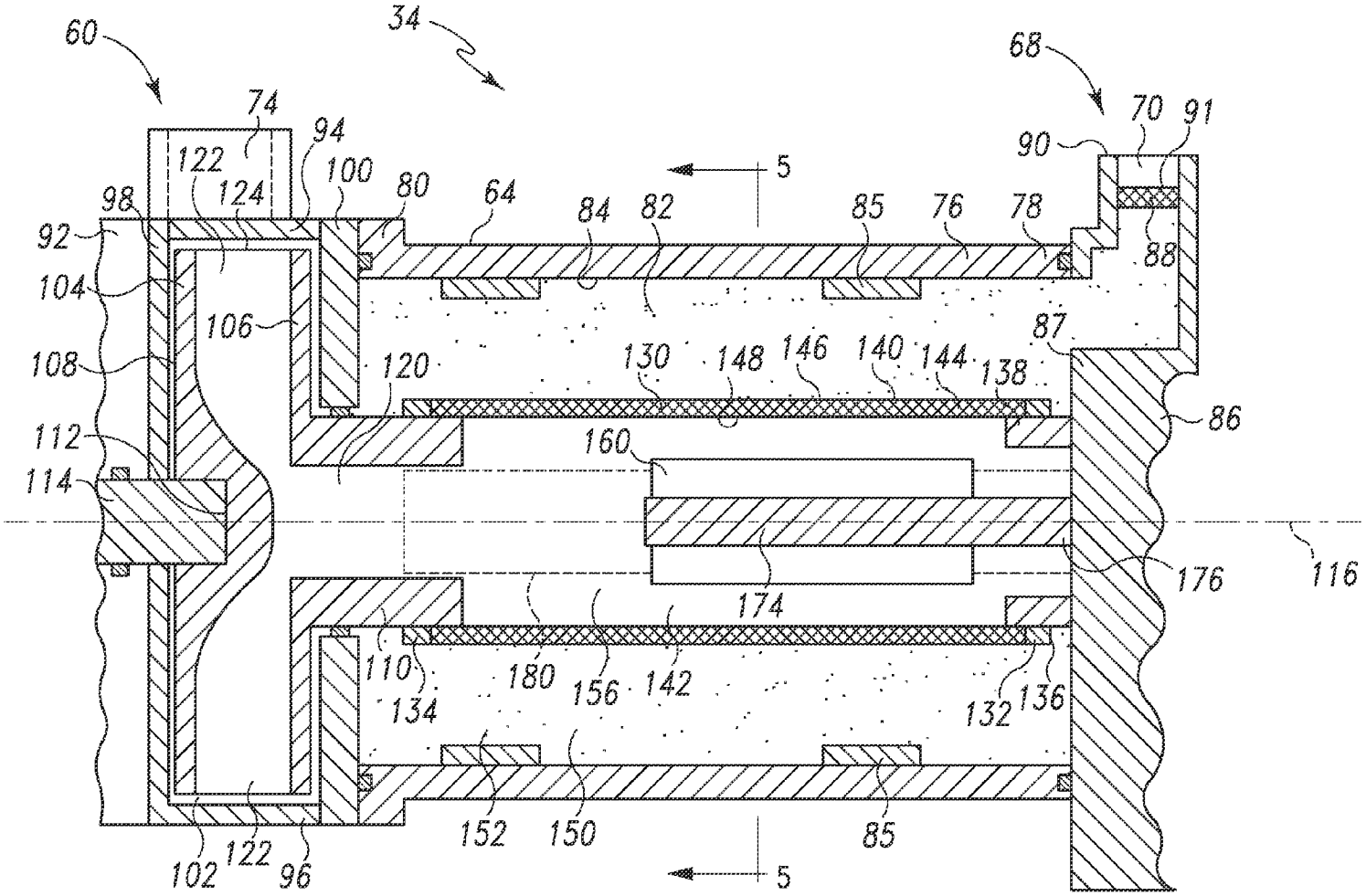
FIG. 4 is a cross-sectional view of the pump and filter assembly of FIG. 3 taken along the line 4-4 shown in FIG. 3.

Referring now to FIG. 4, a cross-sectional view of the recirculation pump assembly 34 is shown. The filter casing 64 is a hollow cylinder having a side wall 76 that extends from an end 78 secured to the manifold 68 to an opposite end 80 secured to the wash pump 60. The side wall 76 defines a filter chamber 82 that extends the length of the filter casing 64.

The side wall 76 has an inner surface 84 facing the filter chamber 82. A number of rectangular ribs 85 extend from the inner surface 84 into the filter chamber 82. The ribs 85 are configured to create drag to counteract the movement of fluid within the filter chamber 82. It should be appreciated that in other embodiments, each of the ribs 85 may take the form of a wedge, cylinder, pyramid, or other shape configured to create drag to counteract the movement of fluid within the filter chamber 82.

The manifold 68 has a main body 86 that is secured to the end 78 of the filter casing 64. The inlet port 70 extends upwardly from the main body 86 and is configured to be coupled to a fluid hose (not shown) extending from the hole 52 defined in the sump 50. The inlet port 70 opens through a sidewall 87 of the main body 86 into the filter chamber 82 of the filter casing 64. As such, during the wash cycle, a mixture of fluid and soil particles advances from the sump 50 into the filter chamber 82 and fills the filter chamber 82. As shown in FIG. 4, the inlet port 70 has a filter screen 88 positioned at an upper end 90. The filter screen 88 has a plurality of holes 91 extending there through. Each of the holes 91 is sized such that large soil particles are prevented from advancing into the filter chamber 82.

A passageway (not shown) places the outlet port 72 of the manifold 68 in fluid communication with the filter chamber 82. When the drain pump 36 is energized, fluid and soil particles from the sump 50 pass downwardly through the inlet port 70 into the filter chamber 82. Fluid then advances from the filter chamber 82 through the passageway and out the outlet port 72.

The wash pump 60 is secured at the opposite end 80 of the filter casing 64. The wash pump 60 includes a motor 92 (see FIG. 3) secured to a cylindrical pump housing 94. The pump housing 94 includes a side wall 96 extending from a base wall 98 to an end wall 100. The base wall 98 is secured to the motor 92 while the end wall 100 is secured to the end 80 of the filter casing 64. The walls 96, 98, 100 define an impeller chamber 102 that fills with fluid during the wash cycle. As shown in FIG. 4, the outlet port 74 is coupled to the side wall 96 of the pump housing 94 and opens into the chamber 102. The outlet port 74 is configured to receive a fluid hose (not shown) such that the outlet port 74 may be fluidly coupled to the spray arm 54.

The wash pump 60 also includes an impeller 104. The impeller 104 has a shell 106 that extends from a back end 108 to a front end 110. The back end 108 of the shell 106 is positioned in the chamber 102 and has a bore 112 formed therein. A drive shaft 114, which is rotatably coupled to the motor 92, is received in the bore 112. The motor 92 acts on the drive shaft 114 to rotate the impeller 104 about an imaginary axis 116 in the direction indicated by arrow 118 (see FIG. 5). The motor 92 is connected to a power supply (not shown), which provides the electric current necessary for the motor 92 to spin the drive shaft 114 and rotate the impeller 104. In the illustrative embodiment, the motor 92 is configured to rotate the impeller 104 about the axis 116 at 3200 rpm.

The front end 110 of the impeller shell 106 is positioned in the filter chamber 82 of the filter casing 64 and has an inlet opening 120 formed in the center thereof. The shell 106 has a number of vanes 122 that extend away from the inlet opening 120 to an outer edge 124 of the shell 106. The rotation of the impeller 104 about the axis 116 draws fluid from the filter chamber 82 of the filter casing 64 into the inlet opening 120. The fluid is then forced by the rotation of the impeller 104 outward along the vanes 122. Fluid exiting the impeller 104 is advanced out of the chamber 102 through the outlet port 74 to the spray arm 54.

As shown in FIG. 4, the front end 110 of the impeller shell 106 is coupled to a rotary filter 130 positioned in the filter chamber 82 of the filter casing 64. The filter 130 has a cylindrical filter drum 132 extending from an end 134 secured to the impeller shell 106 to an end 136 rotatably coupled to a bearing 138, which is secured the main body 86 of the manifold 68. As such, the filter 130 is operable to rotate about the axis 116 with the impeller 104.

A filter sheet 140 extends from one end 134 to the other end 136 of the filter drum 132 and encloses a hollow interior 142. The sheet 140 includes a number of holes 144, and each hole 144 extends from an outer surface 146 of the sheet 140 to an inner surface 148. In the illustrative embodiment, the sheet 140 is a sheet of chemically etched metal. Each hole 144 is sized to allow for the passage of wash fluid into the hollow interior 142 and prevent the passage of soil particles.

As such, the filter sheet 140 divides the filter chamber 82 into two parts. As wash fluid and removed soil particles enter the filter chamber 82 through the inlet port 70, a mixture 150 of fluid and soil particles is collected in the filter chamber 82 in a region 152 external to the filter sheet 140. Because the holes 144 permit fluid to pass into the hollow interior 142, a volume of filtered fluid 156 is formed in the hollow interior 142.

Figure 5:
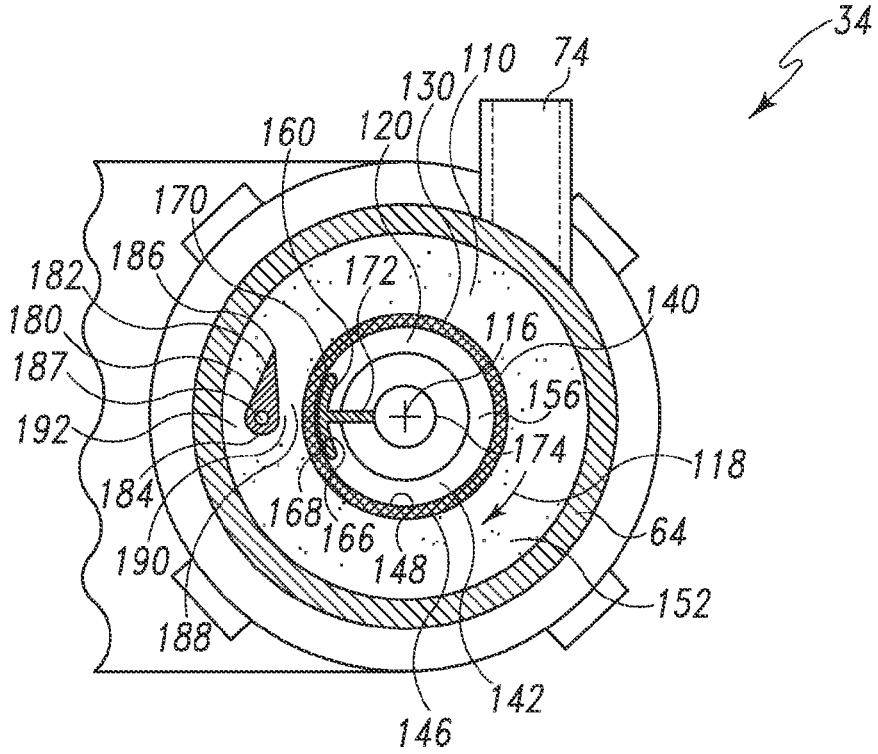
FIG. 5 is a cross-sectional view of the pump and filter assembly of FIG. 3 taken along the line 5-5 shown in FIG. 4 showing the rotary filter with two flow diverters.

Referring now to FIGS. 4 and 5, an artificial boundary or flow diverter 160 is positioned in the hollow interior 142 of the filter 130. The diverter 160 has a body 166 that is positioned adjacent to the inner surface 148 of the sheet 140. The body 166 has an outer surface 168 that defines a circular arc 170 having a radius smaller than the radius of the sheet 140. A number of arms 172 extend away from the body 166 and secure the diverter 160 to a beam 174 positioned in the center of the filter 130. As best seen in FIG. 4, the beam 174 is coupled at an end 176 to the side wall 87 of the manifold 68. In this way, the beam 174 secures the body 166 to the housing 62.

Another flow diverter 180 is positioned between the outer surface 146 of the sheet 140 and the inner surface 84 of the housing 62. The diverter 180 has a fin-shaped body 182 that extends from a leading edge 184 to a trailing end 186. As shown in FIG. 4, the body 182 extends along the length of the filter drum 132 from one end 134 to the other end 136. It will be appreciated that in other embodiments, the diverter 180 may take other forms, such as, for example, having an inner surface that defines a circular arc having a radius larger than the radius of the sheet 140. As shown in FIG. 5, the body 182 is secured to a beam 187. The beam 187 extends from the side wall 87 of the manifold 68. In this way, the beam 187 secures the body 182 to the housing 62.

As shown in FIG. 5, the diverter 180 is positioned opposite the diverter 160 on the same side of the filter chamber 82. The diverter 160 is spaced apart from the diverter 180 so as to create a gap 188 therebetween. The sheet 140 is positioned within the gap 188.

In operation, wash fluid, such as water and/or wash chemistry (i.e., water and/or detergents, enzymes, surfactants, and other cleaning or conditioning chemistry), enters the tub 12 through the hole 48 defined in the side wall 40 and flows into the sump 50 and down the hole 52 defined therein. As the filter chamber 82 fills, wash fluid passes through the holes 144 extending through the filter sheet 140 into the hollow interior 142. After the filter chamber 82 is completely filled and the sump 50 is partially filled with wash fluid, the dishwasher 10 activates the motor 92.

Activation of the motor 92 causes the impeller 104 and the filter 130 to rotate. The rotation of the impeller 104 draws wash fluid from the filter chamber 82 through the filter sheet 140 and into the inlet opening 120 of the impeller shell 106. Fluid then advances outward along the vanes 122 of the impeller shell 106 and out of the chamber 102 through the outlet port 74 to the spray arm 54. When wash fluid is delivered to the spray arm 54, it is expelled from the spray arm 54 onto any dishes or other wares positioned in the washing chamber 14. Wash fluid removes soil particles located on the dishwares, and the mixture of wash fluid and soil particles falls onto the bottom wall 42 of the tub 12. The sloped configuration of the bottom wall 42 directs that mixture into the sump 50 and down the hole 52 defined in the sump 50.

While fluid is permitted to pass through the sheet 140, the size of the holes 144 prevents the soil particles of the mixture 152 from moving into the hollow interior 142. As a result, those soil particles accumulate on the outer surface 146 of the sheet 140 and cover the holes 144, thereby preventing fluid from passing into the hollow interior 142.

The rotation of the filter 130 about the axis 116 causes the unfiltered liquid or mixture 150 of fluid and soil particles within the filter chamber 82 to rotate about the axis 116 in the direction indicated by the arrow 118. Centrifugal force urges the soil particles toward the side wall 76 as the mixture 150 rotates about the axis 116. The diverters 160, 180 divide the mixture 150 into a first portion 190, which advances through the gap 188, and a second portion 192, which bypasses the gap 188. As the portion 190 advances through the gap 188, the angular velocity of the portion 190 increases relative to its previous velocity as well as relative to the second portion 192. The increase in angular velocity results in a low pressure region between the diverters 160, 180. In that low pressure region, accumulated soil particles are lifted from the sheet 140, thereby, cleaning the sheet 140 and permitting the passage of fluid through the holes 144 into the hollow interior 142 to create a filtered liquid. Additionally, the acceleration accompanying the increase in angular velocity as the portion 190 enters the gap 188 provides additional force to lift the accumulated soil particles from the sheet 140.

Figure 6:
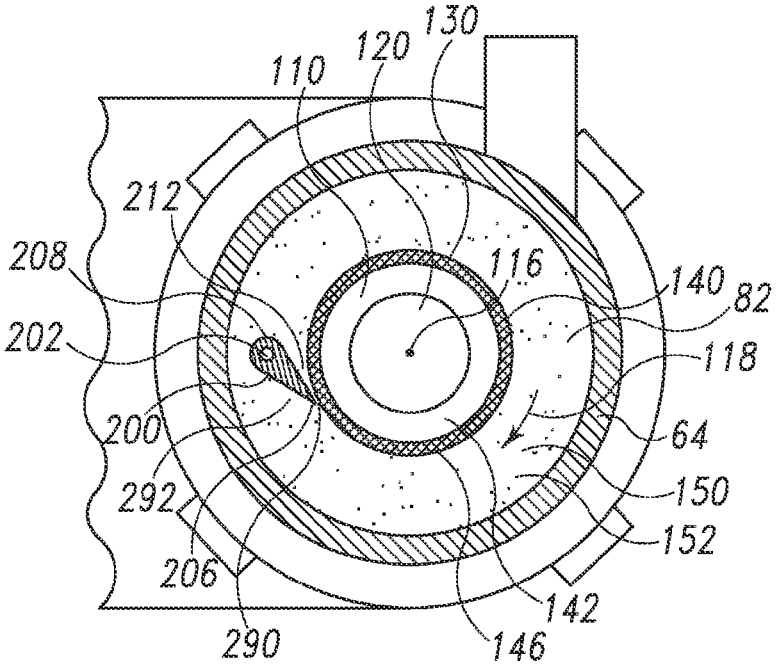
FIG. 6 is a cross-sectional view of the pump and filter assembly of FIG. 3 taken along the line 6-6 shown in FIG. 3 showing a second embodiment of the rotary filter with a single flow diverter.

Referring now to FIG. 6, a cross-section of a second embodiment of the rotary filter 130 with a single flow diverter 200. The diverter 200, like the diverter 180 of the embodiment of FIGS. 1-5, is positioned within the filter chamber 82 external of the hollow interior 142. The diverter 200 is secured to the side wall 87 of the manifold 68 via a beam 202. The diverter 200 has a fin-shaped body 204 that extends from a tip 206 to a trailing end 208. The tip 206 has a leading edge 210 that is positioned proximate to the outer surface 146 of the sheet 140, and the tip 206 and the outer surface 146 of the sheet 140 define a gap 212 therebetween.

In operation, the rotation of the filter 130 about the axis 116 causes the mixture 150 of fluid and soil particles to rotate about the axis 116 in the direction indicated by the arrow 118. The diverter 200 divides the mixture 150 into a first portion 290, which passes through the gap 212 defined between the diverter 200 and the sheet 140, and a second portion 292, which bypasses the gap 212. As the first portion 290 passes through the gap 212, the angular velocity of the first portion 290 of the mixture 150 increases relative to the second portion 292. The increase in angular velocity results in low pressure in the gap 212 between the diverter 200 and the outer surface 146 of the sheet 140. In that low pressure region, accumulated soil particles are lifted from the sheet 140 by the first portion 290 of the fluid, thereby cleaning the sheet 140 and permitting the passage of fluid through the holes 144 into the hollow interior 142. In some embodiments, the gap 212 is sized such that the angular velocity of the first portion 290 is at least sixteen percent greater than the angular velocity of the second portion 292 of the fluid.

Figure 7:
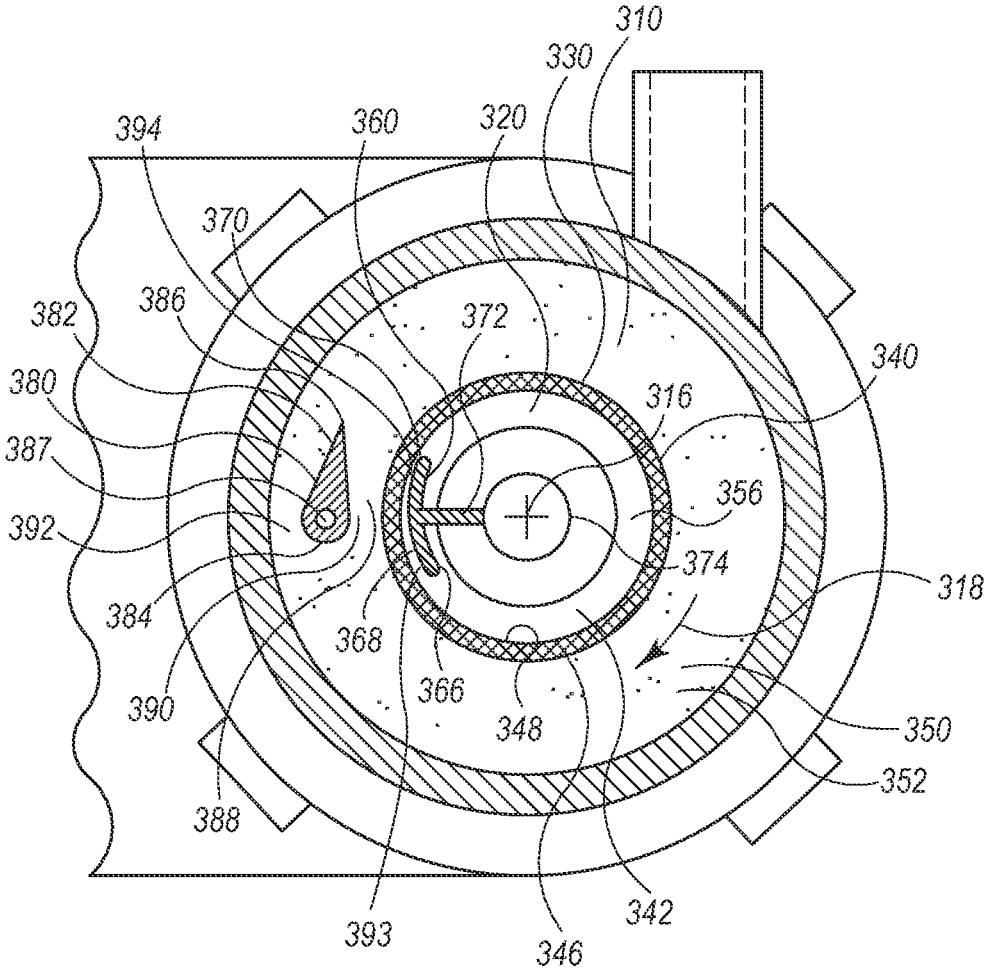
FIG. 7 is a cross-sectional elevation view of the pump and filter assembly of FIG. 3 similar to FIG. 5 and illustrating a third embodiment of the rotary filter with two flow diverters.

FIG. 7 illustrates a third embodiment of the rotary filter 330 with two flow diverters 360 and 380. The third embodiment is similar to the first embodiment having two flow diverters 160 and 180 as illustrated in FIGS. 1-5. Therefore, like parts will be identified with like numerals increased by 200, with it being understood that the description of the like parts of the first embodiment applies to the third embodiment, unless otherwise noted.

One difference between the first embodiment and the third embodiment is that the flow diverter 360 has a body 366 with an outer surface 368 that is less symmetrical than that of the first embodiment 360. More specifically, the body 366 is shaped in such a manner that a leading gap 393 is formed when the body 366 is positioned adjacent to the inner surface 348 of the sheet 340. A trailing gap 394, which is smaller than the leading gap 393, is also formed when the body 366 is positioned adjacent to the inner surface 348 of the sheet 340.

The third embodiment operates much the same way as the first embodiment. That is, the rotation of the filter 330 about the axis 316 causes the mixture 350 of fluid and soil particles to rotate about the axis 316 in the direction indicated by the arrow 318. The diverters 360, 380 divide the mixture 350 into a first portion 390, which advances through the gap 388, and a second portion 392, which bypasses the gap 388. The orientation of the body 366 such that it has a larger leading gap 393 that reduces to a smaller trailing gap 394 results in a decreasing cross-sectional area between the outer surface 368 of the body 366 and the inner surface 348 of the filter sheet 340 along the direction of fluid flow between the body 366 and the filter sheet 340, which creates a wedge action that forces water from the hollow interior 342 through a number of holes 344 to the outer surface 346 of the sheet 340. Thus, a backflow is induced by the leading gap 393. The backwash of water against accumulated soil particles on the sheet 340 better cleans the sheet 340.

Figure 8:
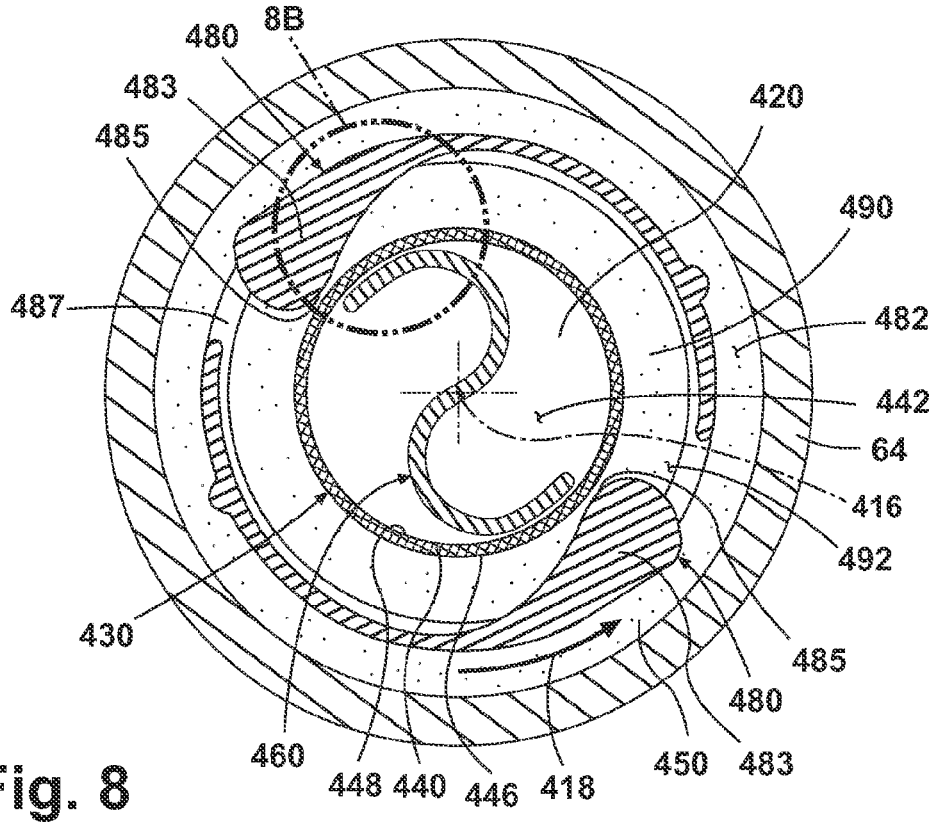
FIGS. 8, 8A, and 8B are cross-sectional elevation views of the pump and filter assembly of FIG. 3, similar to FIG. 7, and illustrate a fourth embodiment of the rotary filter with two flow diverters.
Figure 8A:
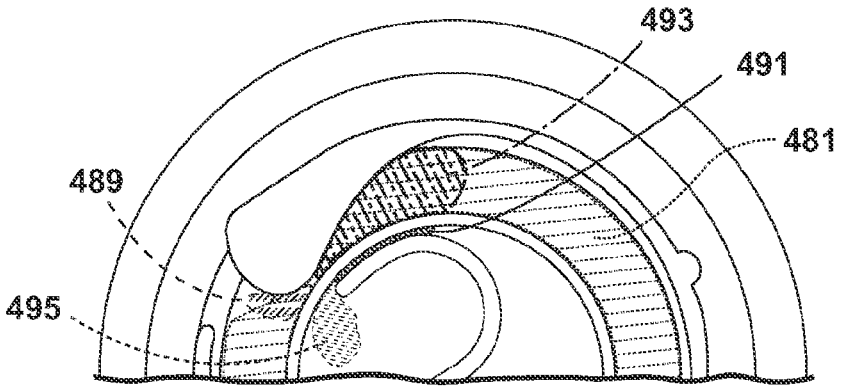
Figure 8B:
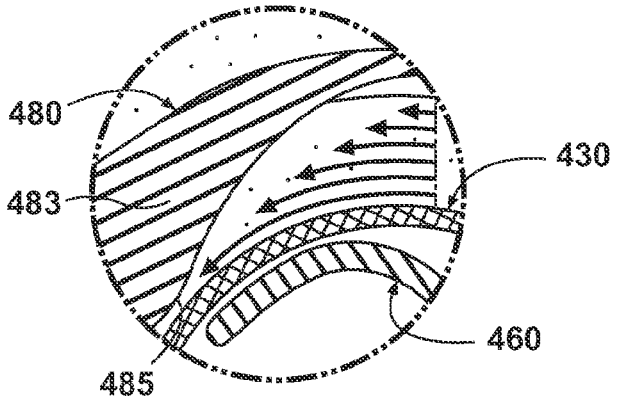

FIGS. 8-8B illustrate a fourth embodiment of the rotating filter 430, with the structure being shown in FIG. 8, the resulting increased shear zone 481 and pressure zones being shown in FIG. 8A, and the angular speed profile of liquid in the increased shear zone 481 is shown in FIG. 8B. The rotating filter 430 is located within the recirculation flow path and has an upstream surface 446 and a downstream surface 448 such that the recirculating liquid passes through the rotating filter 430 from the upstream surface 446 to the downstream surface 448 to effect a filtering of the liquid. In the described flow direction, the upstream surface 446 correlates to the outer surface and that the downstream surface 448 correlates to the inner surface, both of which were previously described above with respect to the first embodiment. If the flow direction is reversed, the downstream surface may correlate with the outer surface and that the upstream surface may correlate with the inner surface. The fourth embodiment is similar to the first embodiment; therefore, like parts will be identified with like numerals increased by 300, with it being understood that the description of the like parts of the first embodiment applies to the fourth embodiment, unless otherwise noted.

One difference between the fourth embodiment and the first embodiment is that the fourth embodiment includes a first artificial boundary 480 in the form of a shroud extending along a portion of the rotating filter 430. Two first artificial boundaries 480 have been illustrated and each first artificial boundary 480 is illustrated as overlying a different portion of the upstream surface 446 to form an increased shear force zone 481. A beam 487 may secure the first artificial boundary 480 to the filter casing 64. The first artificial boundary 480 is illustrated as a concave shroud having an increased thickness portion 483. As the thickness of the first artificial boundary 480 is increased, the distance between the first artificial boundary 480 and the upstream surface 446 decreases. This decrease in distance between the first artificial boundary 480 and the upstream surface 446 occurs in a direction along a rotational direction of the filter 430, which in this embodiment, is counter-clockwise as indicated by arrow 418, and forms a constriction point 485 between the increased thickness portion 483 and the upstream surface 446. After the constriction point 485, the distance between the first artificial boundary 480 and the upstream surface 448 increases from the constriction point 485 in the counter-clockwise direction to form a liquid expansion zone 489.

A second artificial boundary 460 is provided in the form of a concave deflector and overlies a portion the downstream surface 448 to form a liquid pressurizing zone 491 opposite a portion of the first artificial boundary 480. The second artificial boundary 460 may be secured to the ends of the filter casing 64. As illustrated, the distance between the second artificial boundary 460 and the downstream surface 448 decreases in a counter-clockwise direction. The second artificial boundary 460 along with the first artificial boundary 480 form the liquid pressurizing zone 491. The second artificial boundary 460 is illustrated as having two concave deflector portions that are spaced about the downstream surface 448. The two concave deflector portions may be joined to form a single second artificial boundary 460, as illustrated, having an S-shape cross section. Alternatively, it has been contemplated that the two concave deflector portions may form two separate second artificial boundaries. The second artificial boundary 460 may extend axially within the rotating filter 430 to form a flow straightener. Such a flow straightener reduces the rotation of the liquid before the impeller 104 and improves the efficiency of the impeller 104.

The fourth embodiment operates much the same way as the first embodiment. That is, during operation of the dishwasher 10, liquid is recirculated and sprayed by a spray arm 54 of the spraying system to supply a spray of liquid to the washing chamber 17. The liquid then falls onto the bottom wall 42 of the tub 12 and flows to the filter chamber 82, which may define a sump. The housing or casing 64, which defines the filter chamber 82, may be physically remote from the tub 12 such that the filter chamber 82 may form a sump that is also remote from the tub 12. Activation of the motor 92 causes the impeller 104 and the filter 430 to rotate. The rotation of the impeller 104 draws wash fluid from an upstream side in the filter chamber 82 through the rotating filter 430 to a downstream side, into the hollow interior 442, and into the inlet opening 420 where it is then advanced through the recirculation pump assembly 34 back to the spray arm 54.

Referring to FIG. 8A, looking at the flow of liquid through the filter 430, during operation, the rotating filter 430 is rotated about the axis 416 in the counter-clockwise direction and liquid is drawn through the rotating filter 430 from the upstream surface 446 to the downstream surface 448 by the rotation of the impeller 104. The rotation of the filter 430 in the counter-clockwise direction causes the mixture 450 of fluid and soil particles within the filter chamber 482 to rotate about the axis 416 in the direction indicated by the arrow 418. As the mixture 450 is rotated a portion of the mixture 490 advances through a gap 492 formed between the pair of first artificial boundaries 480 and the portion 490 is then in the increased shear force zone 481, which is created by liquid passing between the first artificial boundary 480 and the rotating filter 430.

Referring to FIG. 8B, the increased shear zone 481 is formed by the significant increase in angular velocity of the liquid in the relatively short distance between the first artificial boundary 480 and the rotating filter 430. As the first artificial boundary 480 is stationary, the liquid in contact with the first artificial boundary 480 is also stationary or has no rotational speed. The liquid in contact with the upstream surface 446 has the same angular speed as the rotating filter 430, which is generally in the range of 3000 rpm, which may vary between 1000 to 5000 rpm. The speed of rotation is not limiting to the invention. The increase in the angular speed of the liquid is illustrated as increasing length arrows in FIG. 8B, the longer the arrow length the faster the speed of the liquid. Thus, the liquid in the increased shear zone 481 has an angular speed profile of zero where it is constrained at the first artificial boundary 480 to approximately 3000 rpm at the upstream surface 446, which requires substantial angular acceleration, which locally generates the increased shear forces on the upstream surface 446. Thus, the proximity of the first artificial boundary 480 to the rotating filter 430 causes an increase in the angular velocity of the liquid portion 490 and results in a shear force being applied on the upstream surface 446. This applied shear force aids in the removal of soils on the upstream surface 446 and is attributable to the interaction of the liquid portion 490 and the rotating filter 430. The increased shear zone 481 functions to remove and/or prevent soils from being trapped on the upstream surface 446.

The shear force created by the increased angular acceleration and applied to the upstream surface 446 has a magnitude that is greater than what would be applied if the first artificial boundary 480 were not present. A similar increase in shear force occurs on the downstream surface 448 where the second artificial boundary 460 overlies the downstream surface 448. The liquid would have an angular speed profile of zero at the second artificial boundary 460 and would increase to approximately 3000 rpm at the downstream surface 448, which generates the increased shear forces.

Referring to FIG. 8A, in addition to the increased shear zone 481, a nozzle or jet-like flow through the rotating filter 430 is provided to further clean the rotating filter 430 and is formed by at least one of high pressure zones 491, 493 and lower pressure zones 489, 495 on one of the upstream surface 446 and downstream surface 448. High pressure zone 493 is formed by the decrease in the gap between the first artificial boundary 480 and the rotating filter 430, which functions to create a localized and increasing pressure gradient up to the constriction point 485, beyond which the liquid is free to expand to form the low pressure, expansion zone 489. Similarly a high pressure zone 491 is formed between the downstream surface 448 and the second artificial boundary 460. The high pressure zone 491 is relatively constant until it terminates at the end of the second artificial boundary 460, where the liquid is free to expand and form the low pressure, expansion zone 495.

The high pressure zone 493 is generally opposed by the high pressure zone 491 until the end of the high pressure zone 491, which is short of the constriction point 489. At this point and up to the constriction point 489, the high pressure zone 493 forms a pressure gradient across the rotating filter 430 to generate a flow of liquid through the rotating filter 430 from the upstream surface 446 to the downstream surface 448. The pressure gradient is great enough that the flow has a nozzle or jet-like effect and helps to remove particles from the rotating filter 430. The presence of the low pressure expansion zone 495 opposite the high pressure zone 493 in this area further increases the pressure gradient and the nozzle or jet-like effect. The pressure gradient is great enough at this location to accelerate the water to an angular velocity greater than the rotating filter.

Figure 9:
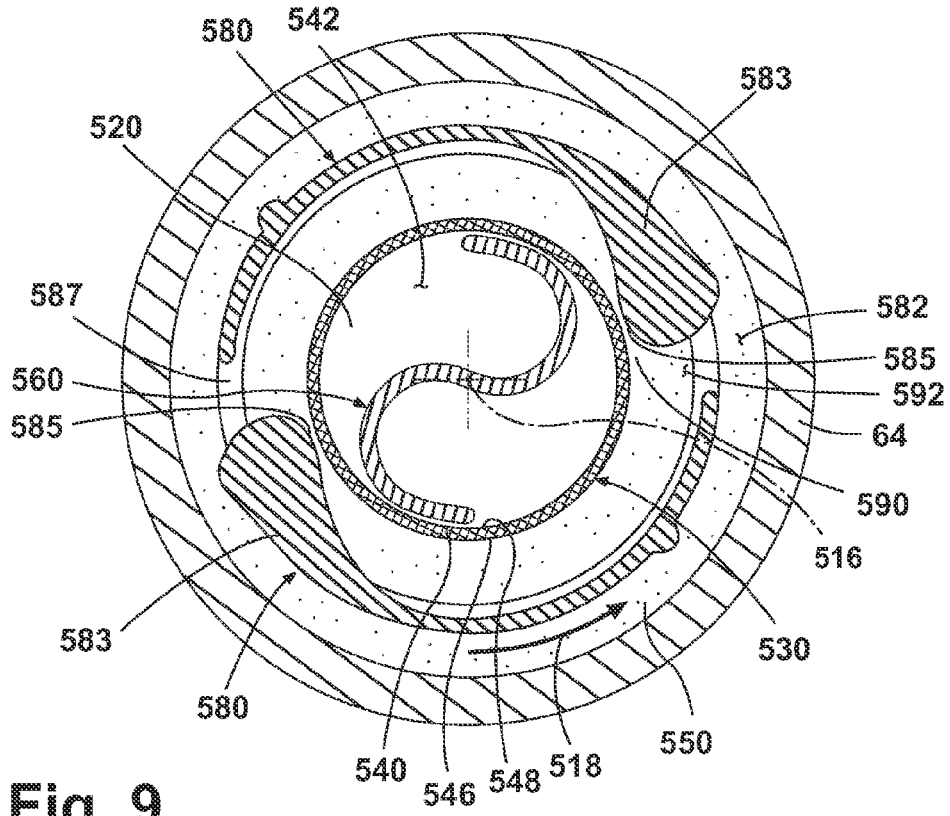
FIGS. 9-9A are cross-sectional elevation views of the pump and filter assembly of FIG. 3, similar to FIGS. 8-8A, and illustrate a fifth embodiment of the rotary filter with two flow diverters.
Figure 9A:
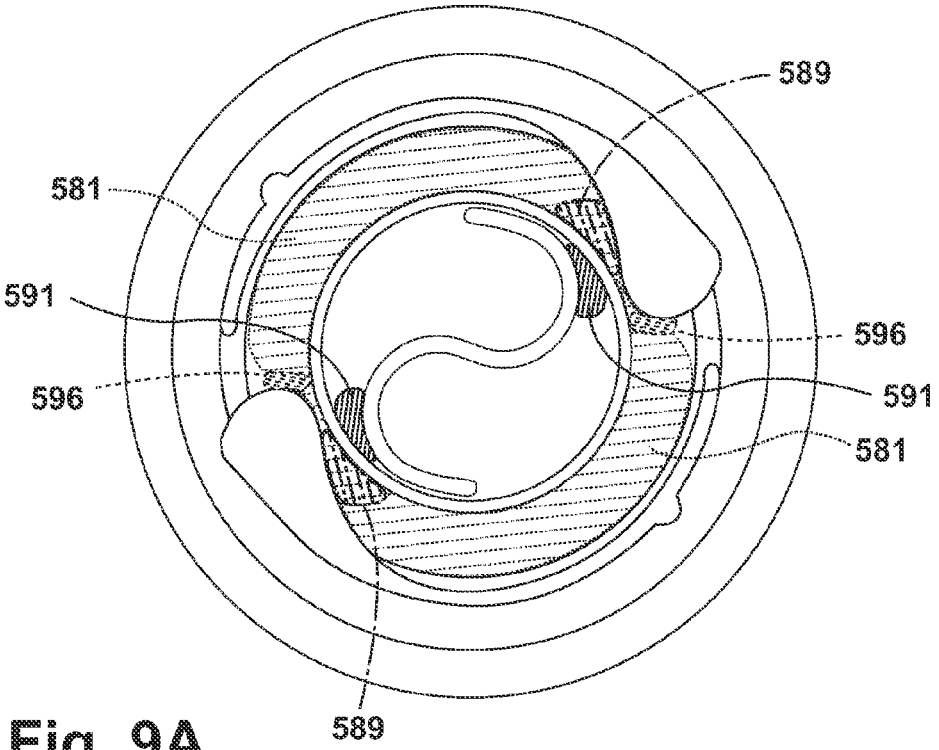

FIGS. 9-9A illustrate a fifth embodiment of the rotating filter 530, with the structure being shown in FIG. 9 and the resulting increased shear zone 581 and pressure zones being shown in FIG. 9A. The fifth embodiment is similar to the fourth embodiment as illustrated in FIG. 8. Therefore, like parts will be identified with like numerals increased by 100, with it being understood that the description of the like parts of the fourth embodiment applies to the fifth embodiment, unless otherwise noted.

One difference between the fifth embodiment and the fourth embodiment is that the first and second artificial boundaries 580, 560 of the fifth embodiment are oriented differently with respect to the rotating filter 530. More specifically, while the first artificial boundary 580 still overlies a portion of the upstream surface 546 and forms an increased shear force zone 581, the shape of the first artificial boundary 580 has been transposed such the constriction point 585 is located just counter-clockwise of the gap 592 and after the constriction point 585 the first artificial boundary 580 diverges from the rotating filter 530 as the thickness of the first artificial boundary 580 is decreased, for a portion of the first artificial boundary 580, in a counter-clockwise direction.

The second artificial boundary 560 in the fifth embodiment is also oriented differently from that of the fourth embodiment both with respect to the portions of the downstream surface 548 it overlies and its relative orientation to the first artificial boundary 580. As with the fourth embodiment, the second artificial boundary 560 has an S-shape cross section and the second artificial boundary 560 extends axially within the rotating filter 530 to form a flow straightener.

The fifth embodiment operates much the same as the fourth embodiment and the increased shear zone 581 is formed by the significant increase in angular velocity of the liquid due to the relatively short distance between the first artificial boundary 580 and the rotating filter 530. As the constriction point 585 is located just counter-clockwise of the gap 592 the liquid portion 590 that enters into the gap 592 is subjected to a significant increase in angular velocity because of the proximity of the constriction point 585 to the rotating filter 530. This increase in the angular velocity of the liquid portion 590 results in a shear force being applied on the upstream surface 546.

A localized pressure increase results from the constriction point 585 being located so near the gap 592, which forms a liquid pressurized zone or high pressure zone 596 on the upstream surface 546 just prior to the constriction point 585. Conversely, a liquid expansion zone or a low pressure zone 589 is formed on the opposite side of the constriction point 585 as the distance between the first artificial boundary 580 and the upstream surface 546 increases from the constriction point 585 in the counter-clockwise direction. Similarly, a high pressure zone 591 is formed between the downstream surface 548 and the second artificial boundary 560.

The pressure zone 596 forms a pressure gradient across the rotating filter 530 before the constriction point 585 to form a nozzle or jet-like flow through the rotating filter to further clean the rotating filter 530. The low pressure zone 589 and high pressure zone 591 form a backwash liquid flow from the downstream surface 548 to the upstream surface 546 along at least a portion of the filter 530. Where the low pressure zone 589 and high pressure zone 591 physically oppose each other, the backwash effect is enhanced as compared to the portions where they are not opposed.

The backwashing aids in a removal of soils on the upstream surface 546. More specifically, the backwash liquid flow lifts accumulated soil particles from the upstream surface 546 of at least a portion of the rotating filter 530. The backwash liquid flow thereby aids in cleaning the filter sheet 540 of the rotating filter 530 such that the passage of fluid into the hollow interior 542 is permitted.

In the fifth embodiment, the nozzle effect and the backflow effect cooperate to form a local flow circulation path from the upstream surface to the downstream surface and back to the upstream surface, which aids in cleaning the rotating filter. This circulation occurs because the nozzle or jet-like flow occurs just prior to the backwash flow. Thus, liquid passing from the upstream surface to the downstream surface as part of the nozzle or jet-like flow almost immediately drawn into the backflow and returned to the upstream surface.

Figure 10:
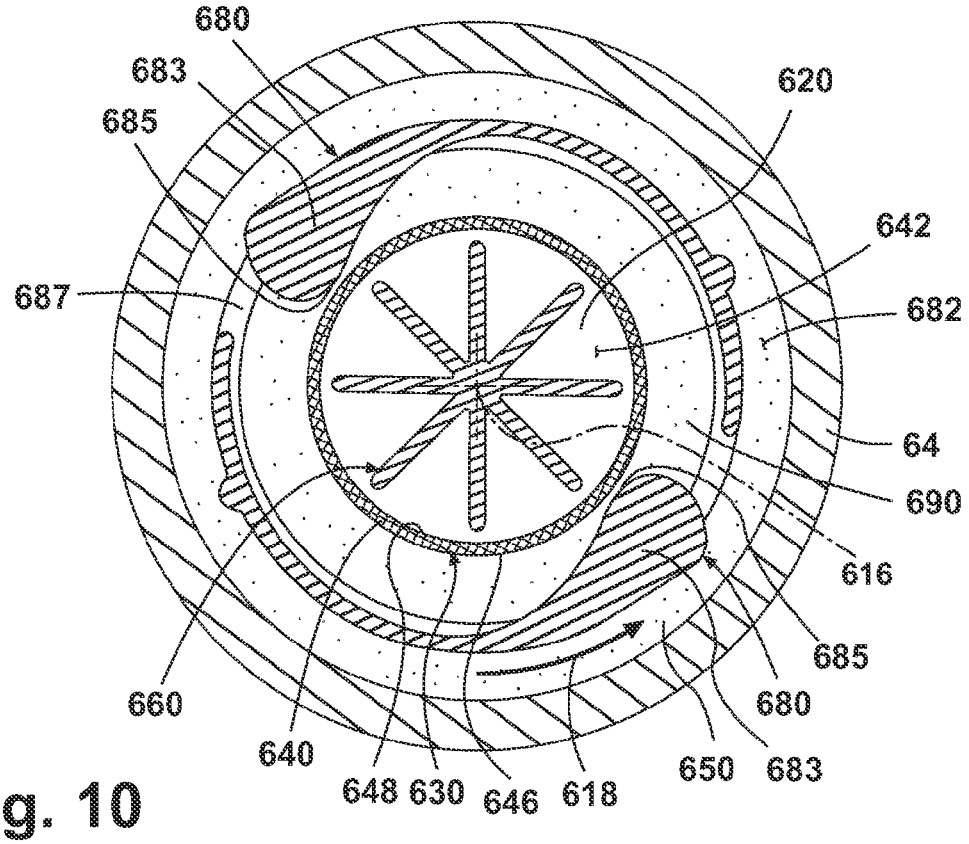
FIGS. 10-10A are cross-sectional elevation views of the pump and filter assembly of FIG. 3, similar to FIGS. 8-8A, and illustrating a sixth embodiment of the rotary filter with two flow diverters.
Figure 10A:
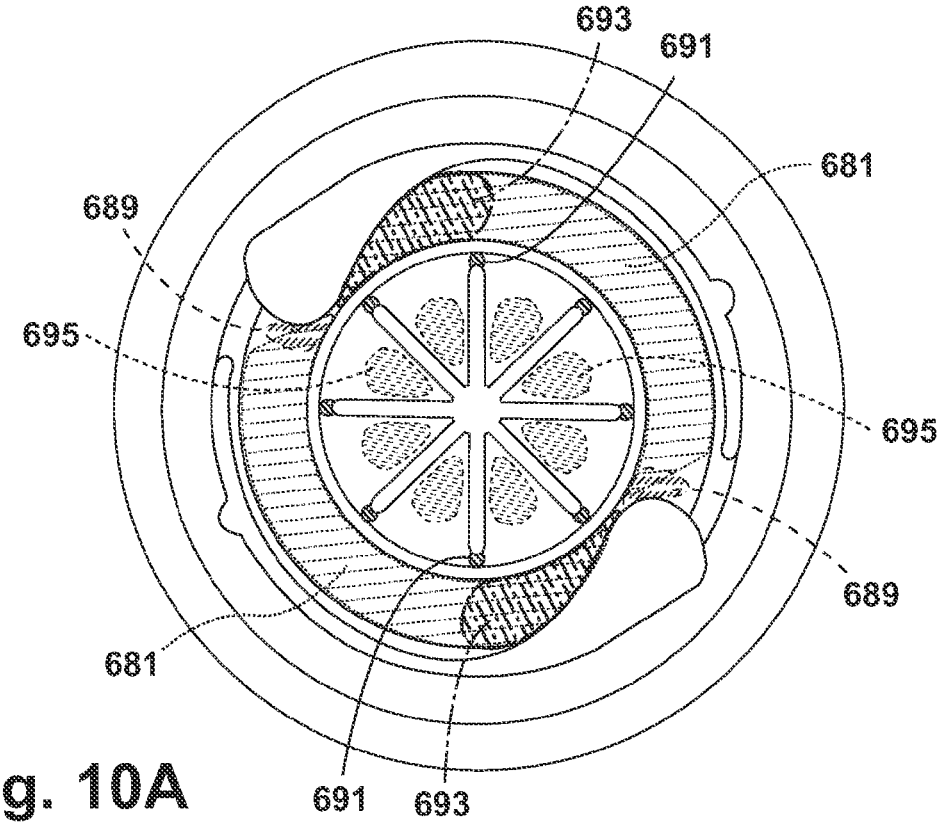

FIGS. 10-10A illustrate a sixth embodiment of the rotating filter 630, with the structure being shown in FIG. 10 and the resulting increased shear zone 681 and pressure zones being shown in FIG. 10A. The sixth embodiment is similar to the fourth embodiment as illustrated in FIG. 8. Therefore, like parts will be identified with like numerals increased by 200, with it being understood that the description of the like parts of the fourth embodiment applies to the sixth embodiment, unless otherwise noted.

The difference between the sixth embodiment and the fourth embodiment is that the second artificial boundary 660 in the sixth embodiment has a multi-pointed star shape in cross section. As with the fourth embodiment, the second artificial boundary 660 extends axially within the rotating filter 630 to form a flow straightener. Such a flow straightener reduces the rotation of the liquid before the impeller 104 and improves the efficiency of the impeller 104. It has been determined that the second artificial boundary 660 provides for the highest flow rate through the filter assembly with the lowest power consumption.

As with the fourth embodiment, the first artificial boundaries 680 form increased shear force zones 681 and liquid expansion zones 689. Further, the multiple points of the second artificial boundary 660 overlie a portion the downstream surface 648 and form liquid pressurizing zones 691 opposite portions of the first artificial boundary 680. Low pressure zones 695 are formed between the multiple points of the second artificial boundary 660.

The sixth embodiment operates much the same way as the fourth embodiment. Except that the liquid pressurizing zones 691 on the downstream surface 648 are much smaller than in the fourth embodiment and thus the pressure gradient, which is created is smaller. Further, the low pressure zones 695 create multiple pressure drops across the filter sheet 640 and the portion 690 is drawn through to the hollow interior 642 at a higher flow rate. This concept also creates multiple internal shear locations, which further improves the cleaning of the filter.

Figure 11:
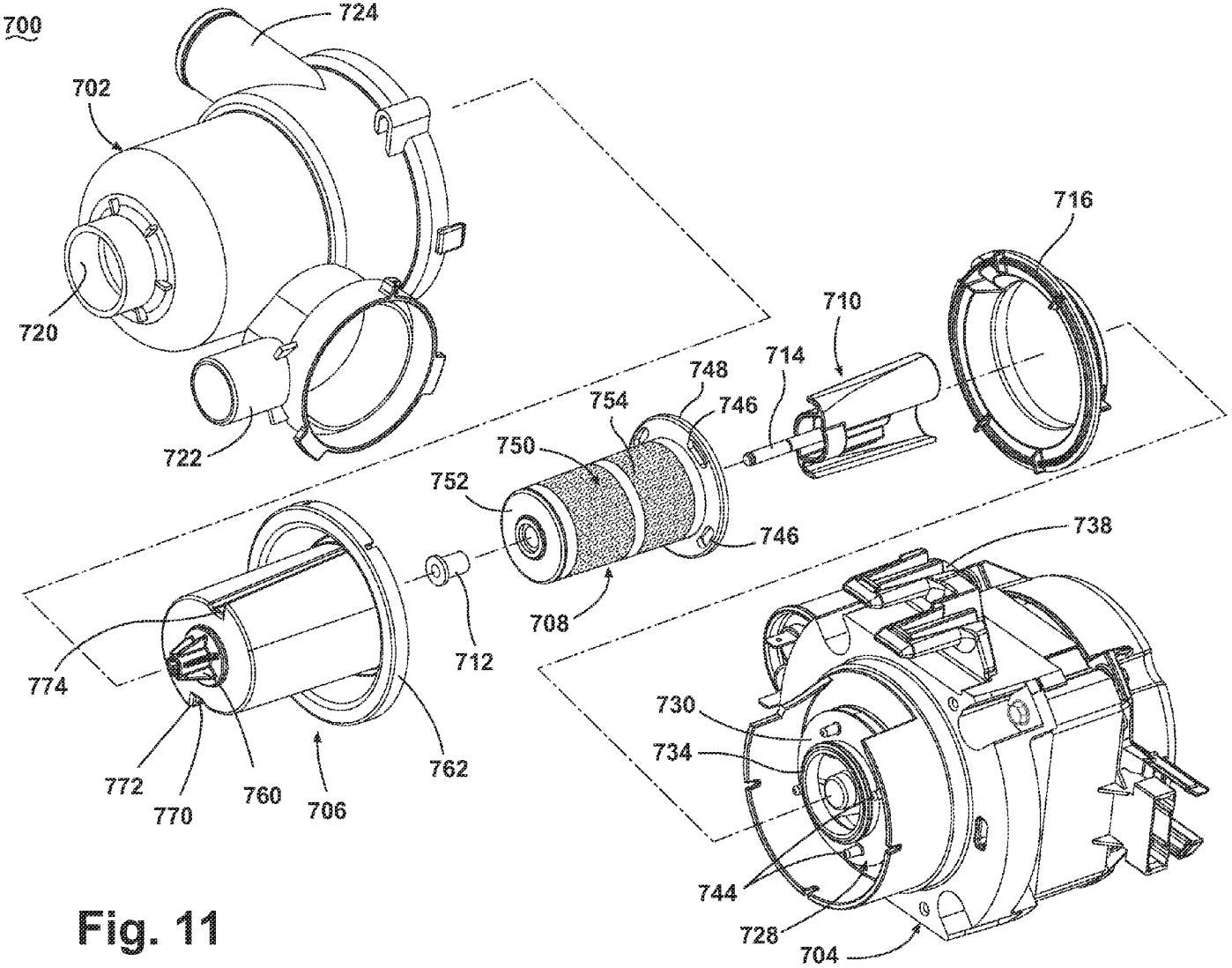
FIG. 11 is an exploded view of a seventh embodiment of a pump and filter assembly for the dishwashing machine of FIG. 1.
Figure 12:
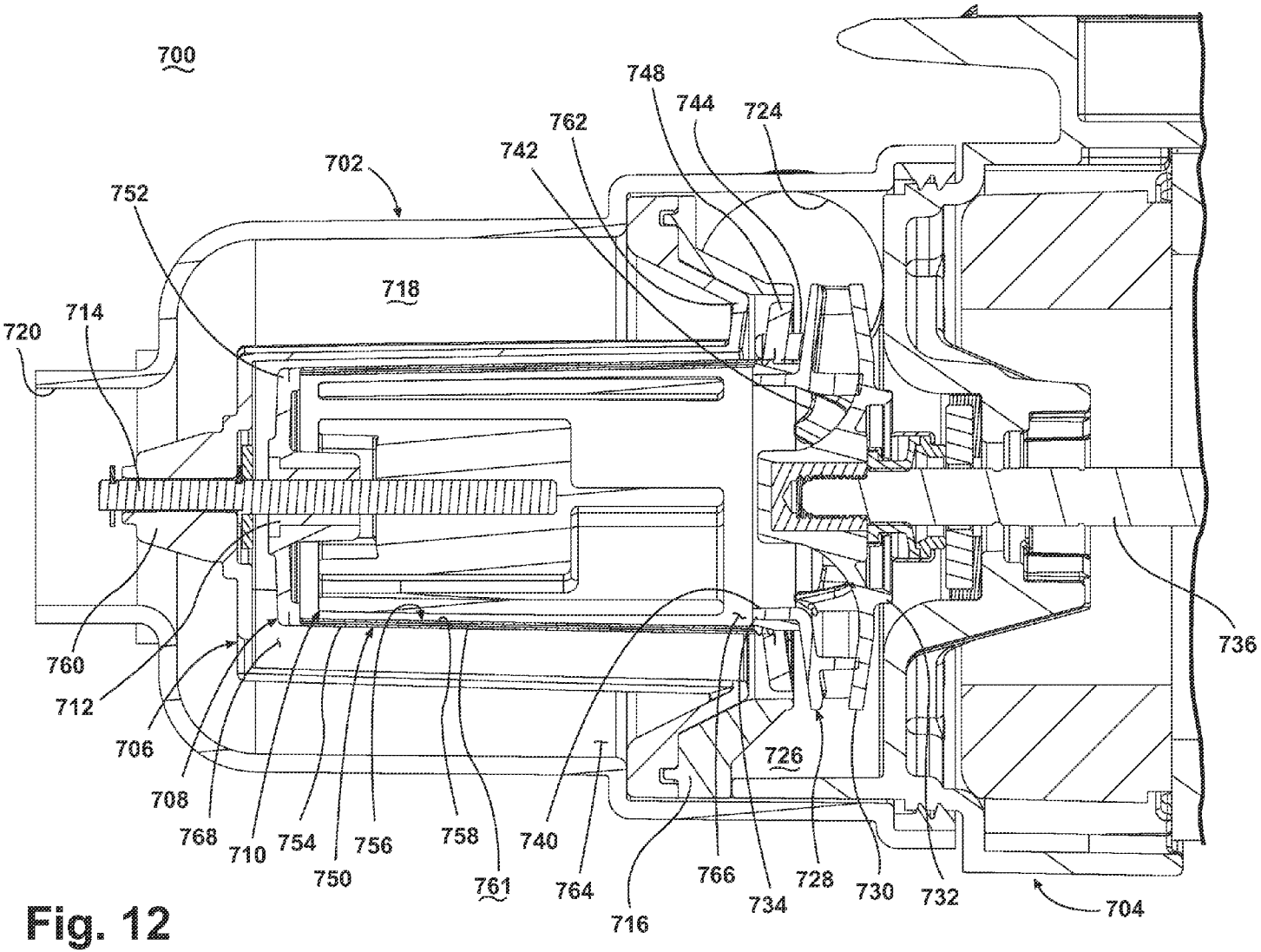
FIG. 12 is a cross-sectional view of the assembled pump and filter assembly of FIG. 11.

Referring now to FIGS. 11 and 12 a seventh embodiment of a pump and filter assembly 700, which may be used in the dishwasher 10 is shown. The seventh embodiment is similar in some aspects to both the first and fifth embodiments and part numbers begin with the 700 series. It may be understood that while like parts may not include like numerals the descriptions of the like parts of the earlier embodiments apply to the seventh embodiment, unless otherwise noted.

The pump and filter assembly 700 includes a modified filter casing or filter housing 702, a wash or recirculation pump 704, a shroud 706, a rotating filter 708, and an internal flow diverter 710, as well as a bearing 712, a shaft 714, and a separator ring 716. The filter housing 702 defines a filter chamber 718 that extends the length of the filter casing 702 and includes an inlet port 720, a drain outlet port 722, and a recirculation outlet port 724. The inlet port 720 is configured to be coupled to a fluid hose (not shown) extending from the sump 50. The filter chamber 718, depending on the location of the pump and filter assembly 700, may functionally be part of the sump 50 or replace the sump 50. The drain outlet port 722 is coupled to a drain pump such that actuation of the drain pump drains the liquid and any foreign objects within the filter chamber 718. The recirculation outlet port 724 is configured to receive a fluid hose (not shown) such that the recirculation outlet port 724 may be fluidly coupled to the spray arm 54. The recirculation outlet port 724 is fluidly coupled to an impeller chamber 726 of the wash pump 710 such that when the recirculation pump 704 is operated liquid may be supplied to the spray arm 54.

The recirculation pump 704 also includes an impeller 728, which has a shell 730 that extends from a back end 732 to a front end 734 and may be rotatably driven through a drive shaft 736 by the motor 738. The front end 734 of the impeller shell 730 is positioned in the filter chamber 718 and has an inlet opening 740 formed in the center thereof. A number of vanes 742 may extend away from the inlet opening 740 to an outer edge of the shell 730. Several pins 744 on the front end 734 of the impeller shell 730 may be received within openings 746 in a first end 748 of the filter 708 such that the filter 708 may be operably coupled to the impeller 728 such that rotation of the impeller 728 effects the rotation of the filter 708.

The rotating filter 708 may have a single filter sheet enclosing a hollow interior as described with respect to the above embodiments. Alternatively, as illustrated, the rotating filter 708 may have a first filter element 750 extending between the first end 748 and a second end 752 and forming an outer or upstream surface 754 and a second filter element 756 forming an inner or downstream surface 758 and located in the recirculation flow path such that the recirculation flow path passes through the filter 708 from the upstream surface 754 to the downstream surface 758 to effect a filtering of the sprayed liquid. The first filter element 750 and the second filter element 756 may be affixed to each other or may be spaced apart from each other by a gap 761. By way of non-limiting example, the first filter element 750 has been illustrated as a cylinder and the second filter element 756 has been illustrated as a cylinder received within the first filter element 750.

The first filter element 750 and second filter element 756 may be structurally different from each other, may be made of different materials, and may have different properties attributable to them. For example, the first filter element 750 may be a courser filter than the second filter element 756. Both the first and second filter elements 750, 756 may be perforated (not shown) and the perforations of the first filter element 750 may be different from the perforations of the second filter element 756, with the size of the perforations providing the difference in filtering.

It is contemplated that the first filter element 750 may be more resistant to foreign object damage than the second filter element 756. The resistance to foreign object damage may be provided in a variety of different ways. The first filter element 750 may be made from a different or stronger material than the second filter element 756. The first filter element 750 may be made from the same material as the second filter element 756, but having a greater thickness. The distribution of the perforations may also contribute to the first filter element 750 being stronger. The perforations of the first filter element 750 may leave a more non-perforated area for a given surface area than the second filter element 756, which may provide the first filter element 750 with greater strength, especially hoop strength. It is also contemplated that the perforations of the first filter element 750 may be arranged to leave non-perforated bands encircling the first filter element 750, with the non-perforated bands functioning as strengthening ribs.

The bearing 712 may be mounted in the second end 752 of the filter 708 and rotatably receive the stationary shaft 714, which in turn is mounted to a first end 760 of the stationary shroud 706. In this way, the filter 708 is rotatably mounted to the stationary shaft 714 with the bearing 712. The internal flow diverter 710 is also mounted on the stationary shaft 714. The shroud 706 is mounted at a second end 762 to the separator ring 716, which in turn is attached to the wash pump 760. Thus, the shroud 706 and internal flow diverter 710 are stationary while the filter 708 is free to rotate about the stationary shaft 714 in response to rotation of the impeller 728.

When assembled, the filter chamber 718 envelopes the shroud 706 and the filter 708 fluidly divides the filter chamber 718 into two regions, an upstream region 764 external to the filter 708 and a downstream region 766. The shroud 706 also defines an interior 768, within which the rotating filter 708 is located and which is fluidly accessible through multiple inlet openings 770. It is contemplated that the shroud 706 may include any number of inlet openings 770 including a singular inlet opening. The shroud 706 is illustrated as defining a top edge 772 of the inlet opening 770 and a lower edge 774 of the inlet opening 770.

Figure 13:
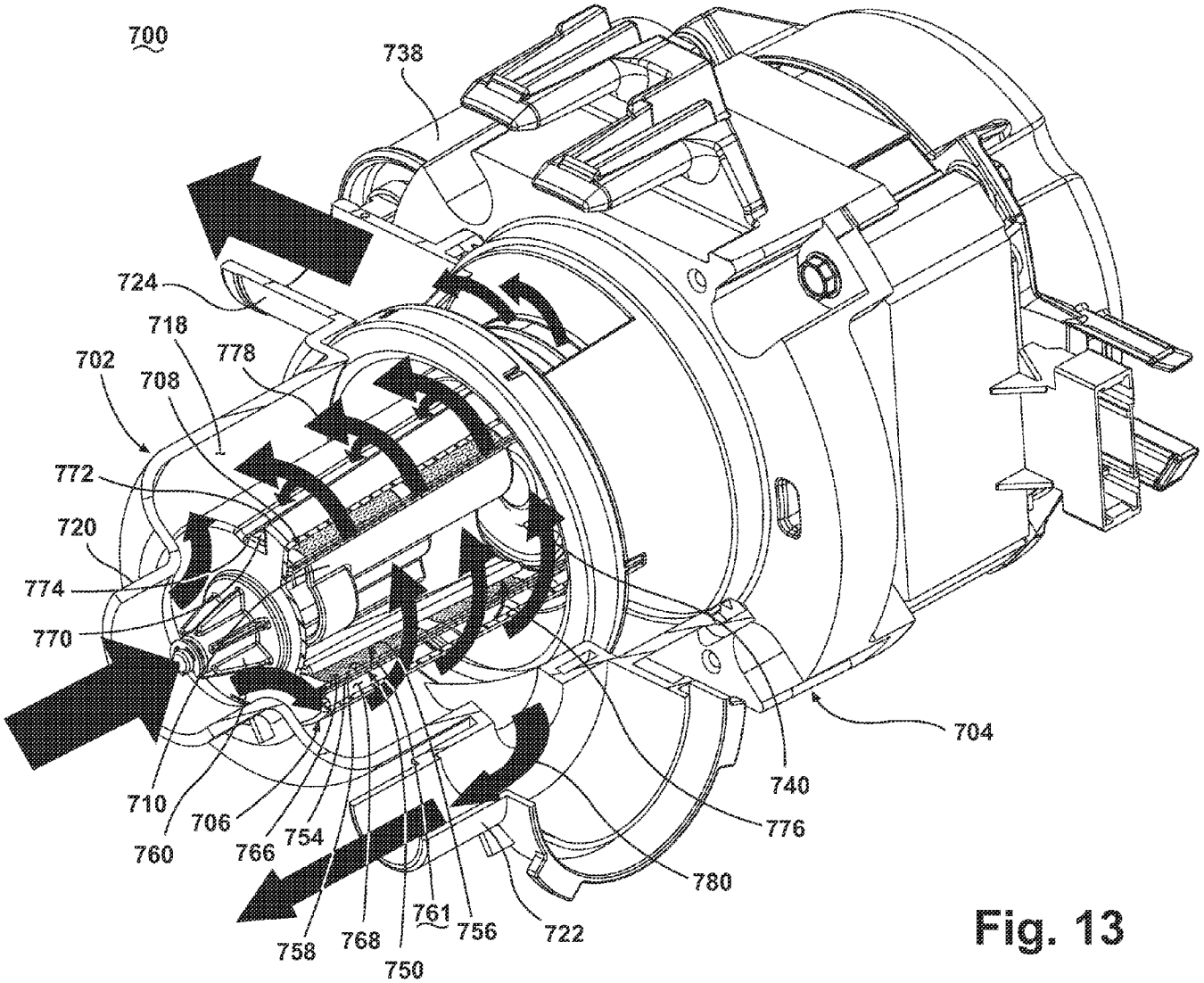
FIG. 13 is a perspective view of the assembled pump and filer assembly of FIG. 11 with a portion removed to better illustrate flow paths within the assembly.

The seventh embodiment operates much the same as the above described embodiments in that the motor 738 acts on the impeller drive shaft 736 to rotate the impeller 728 and the filter 708 in the direction indicated by arrow 776, as illustrated in FIG. 13. The rotation of the impeller 728 draws liquid from the filter chamber 718 into the inlet opening 740. The liquid is then forced by the rotation of the impeller 728 outward along the vanes 742 and is advanced out of the impeller chamber 726 through the recirculation outlet port 724 to the spray arm 54. The separator ring 716 acts to separate the filtered water in the impeller chamber 726 from the mixture of liquid and soils in the filter chamber 718. The recirculation pump 704 is fluidly coupled downstream of the downstream surface 758 of the filter 708 and if the recirculation pump 704 is shut off then any liquid not expelled will settle in the filter chamber 718.

FIG. 13 also more clearly illustrates a portion of the recirculation flow path indicated by arrows 778 and a portion of the drain path indicated by arrows 780. The liquid is shown as traveling along the recirculation flow path into the filter chamber 718 from the inlet port 720. The rotation of the filter 708, which is illustrated in the counter-clockwise direction, causes the liquid and soils therein to rotate in the same direction within the filter chamber 718. The recirculation flow path is thus illustrated as circumscribing at least a portion of the shroud 706 and as entering into the interior 768 through the inlet openings 770. In this manner, the multiple inlet opening 770 may be thought of as facing downstream to the recirculation flow path. It is most likely that some of the liquid in the recirculation flow path may make one or more complete trips around the shroud 706 prior to entering the inlet openings 770. The number of trips is somewhat dependent upon the suction provided by the recirculation pump 704 and the rotation of the filter 708.

Figure 14:
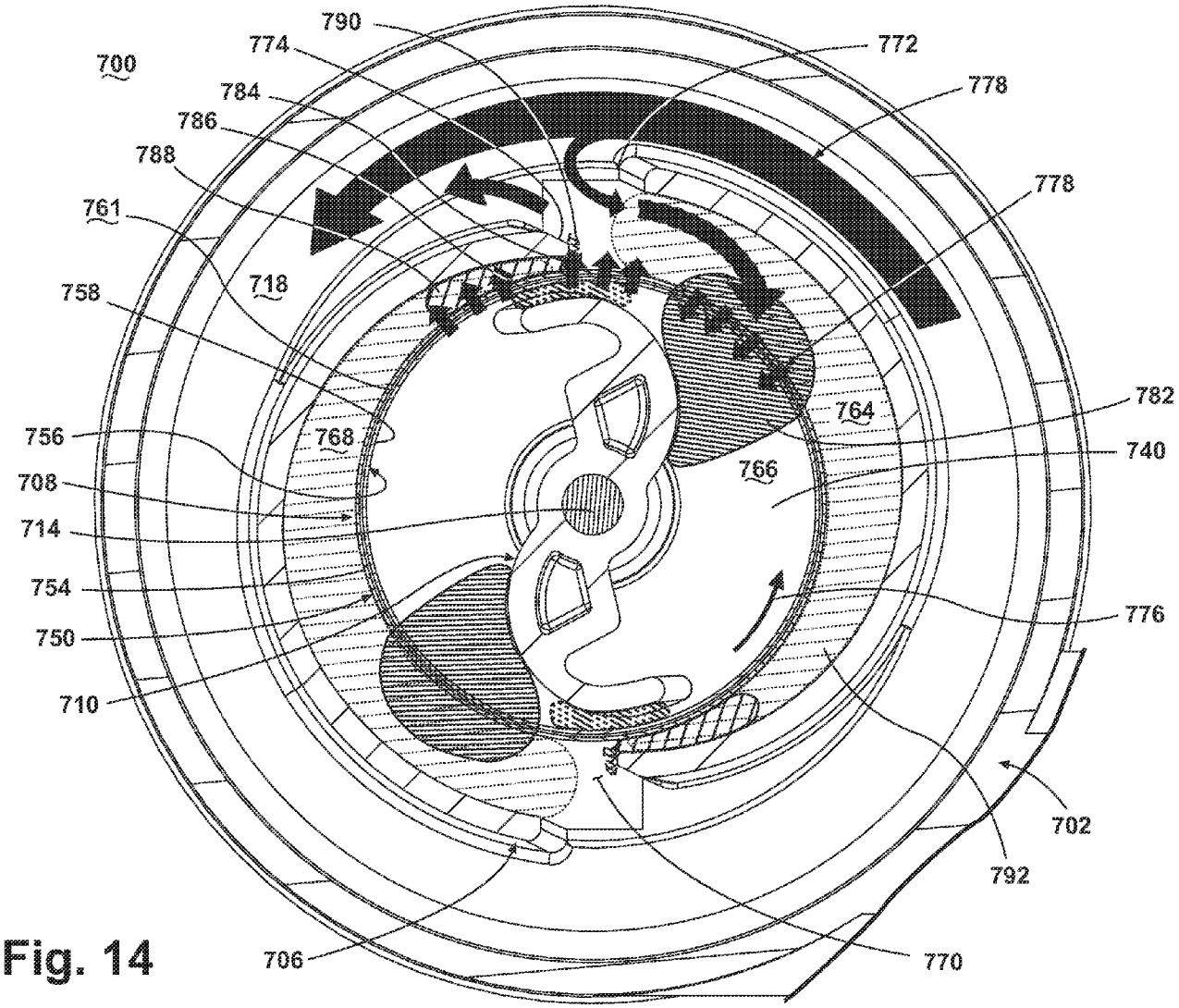
FIG. 14 is a cross-sectional elevation view of a portion of the pump and filter assembly of FIG. 11.

FIG. 14 illustrates more clearly the shroud 706, its inlet openings 770, the internal flow diverter 710, and the flow of the liquid along the recirculation flow path as the recirculation flow path passes through the filter 708 from the upstream surface 754 to the downstream surface 758 and into the inlet opening 740 of the impeller 728. Multiple arrows 778 illustrate the travel of liquid along the recirculation flow path as well as various zones created in the filter chamber 718 during operation including: a first low pressure zone 782, a backflow zone 784, first high pressure zone 786, a second low pressure zone 788, a second high pressure zone 790, and a shear force zone 792. These zones impact the travel of the liquid along the liquid recirculation flow path.

As may be seen a portion of the liquid is drawn around the shroud 706 and into the inlet opening 770 in a direction opposite that of the rotation of the filter 708. The shape of the shroud 706 and internal flow diverter 710 as well as the suction from the recirculation pump 704, which causes a first low pressure zone 788, results in a sharp turning of a portion of the liquid, which helps discourage foreign objects from entering the inlet opening 770 as they are less able to make the same turn around the shroud 706 and into the inlet opening 770.

The internal flow diverter 710 acts as a first artificial boundary, which overlays at least a portion of the filter 708 to form the backflow zone 784, as indicated by the arrows, where the liquid flows from the downstream surface 758 to the upstream surface 754. Essentially, the backflow zones 784 are created due to pressure gradients within the filter chamber 718, which act to drive the liquid back through the filter 708 from the downstream surface 758 to the upstream surface 754. Each of the multiple inlet openings 770 has a corresponding first artificial boundary created by the internal flow diverter 710 and each first artificial boundary overlies a portion of the downstream surface 758 to form a first high pressure zone 786 between it and the filter 708. As illustrated, the distance between the first artificial boundaries formed by the internal flow diverter 710 and the downstream surface 758 decreases in a counter-clockwise direction, which is the same direction as the rotational direction of the filter 708, which functions to create a localized and increasing pressure gradient up to the end of the artificial boundary, beyond which the liquid is free to expand.

As may be seen, at least part of the first high pressure zone 786 is at a location that is rotationally in front of the inlet opening 770. Terms like "rotationally in front of" are used in this description as a relative reference system based on the rotational direction of the filter 708 and the inlet opening 770. Because the filter 708 rotates counter-clockwise and the first high pressure zone 786 in a counter-clockwise direction from the inlet opening 770 it may be described as being rotationally in front of the inlet opening 770. The first artificial boundary is located such that at least a portion of the backflow zone 784 extends into the inlet opening 770 and liquid therein outflows in opposition to the recirculation flow path flowing through the inlet opening 770 towards the filter 708. The location of the first artificial boundary and the created backflow zone 784, with the respect to the inlet opening 770, are such that the backflow zone 784 retards entry of foreign objects in the liquid into the inlet opening 770 along the recirculation flow path 778. More specifically, any foreign objects that are drawn around the shroud 706 would naturally make a more gradual turn into the inlet opening 770 putting them into the backflow zone 784 such that their travel towards the filter 708 is opposed by the liquid in the backflow zone 784 such that the foreign objects will be forced into the outflow and back into the recirculation path circumscribing the shroud 706.

The first artificial boundaries are illustrated as being formed by the two concave deflector portions of the internal flow diverter 710. The first artificial boundaries are spaced about the downstream surface 758 and joined to form the single internal flow diverter 710. Although a single body forms the internal flow diverter 710, it is contemplated that multiple concave bodies could form the multiple first artificial boundaries. The body of the internal flow diverter 710 may extend axially within the rotating filter 708 to form a flow straightener. Such a flow straightener reduces the rotation of the liquid before the impeller 728 and improves the efficiency of the recirculation pump 704.

The shroud 706 may be thought of as forming a second artificial boundary located adjacent the upstream surface 754, which creates a second low pressure zone 788 that is formed as the distance between the second artificial boundary and the upstream surface 754 increases in the counter-clockwise direction. Where the second low pressure zone 788 and first high pressure zone 786 physically oppose each other, the backflow effect is enhanced as the second low pressure zone 788 increases the pressure gradient near the first high pressure zone and gives the liquid additional room to expand. It is contemplated that the creation of the second low pressure zone 788 on the upstream surface 754 may create enough of a pressure gradient that without it, the presence of the internal flow diverter 710 may create a backflow and cause a portion of the liquid to flow from the downstream surface 758 to the upstream surface. Further, a portion of the shroud 706 is also illustrated as creating a second high pressure zone 790 that is at a location rotationally in front of the inlet opening 770 and also aids in retarding entry of foreign objects in the liquid into the inlet opening 770. Further yet, at least a portion of the shroud 706 and the second artificial boundary formed thereby creates a shear force zone 792 along the upstream surface 754 as explained above with respect to the other embodiments.

There are a plurality of advantages of the present disclosure arising from the various features of the method, apparatuses, and system described herein. For example, the embodiments of the apparatus described above allows for enhanced filtration such that soil is filtered from the liquid and not re-deposited on utensils. Further, the embodiments of the apparatus described above allow for cleaning of the filter throughout the life of the dishwasher and this maximizes the performance of the dishwasher. Thus, such embodiments require less user maintenance than required by typical dishwashers.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dishwasher comprising:

a tub at least partially defining a washing chamber;

a liquid spraying system supplying a spray of liquid to the washing chamber;

a liquid recirculation system comprising a recirculation pump with a rotatable impeller for recirculating sprayed liquid from the washing chamber to the liquid spraying system to define a recirculation flow path; and a cylindrical rotating filter enclosing a hollow interior, the cylindrical rotating filter having a first filter element forming an outer upstream surface and a second filter element forming an inner downstream surface that defines the hollow interior and located in the recirculation flow path such that the recirculation flow path passes through the filter from the upstream surface to the downstream surface to effect a filtering of the sprayed liquid and the cylindrical rotating filter fluidly divides the recirculation flow path into a first part that contains filtered soil particles and a second part that excludes filtered soil particles and where the cylindrical rotating filter is operably coupled to the rotatable impeller of the recirculation pump to effect rotation of the cylindrical rotating filter; and wherein the first filter element is more resistant to foreign object damage than the second filter element.

2. The dishwasher of claim 1 wherein the first filter element and the second filter element are affixed to each other.

3. The dishwasher of claim 1 wherein the first filter element is structurally stronger than the second filter element.

4. The dishwasher of claim 1 wherein the first filter element is a courser filter than the second filter element.

5. The dishwasher of claim 1 wherein the first filter element is a cylinder and the second filter element is a cylinder received within the first filter element.

6. The dishwasher of claim 1 wherein the first and second filter elements are perforated, with the perforations of the first filter element different from the perforations of the second filter element to render the first filter element more resistant to foreign object damage.

7. The dishwasher of claim 6 wherein the perforations of the first filter element leave more non-perforated areas than the second filter element.

8. The dishwasher of claim 6 wherein the perforations of the first filter element form less open space per unit area than the perforations of the second filter element.

* * * * *